US011076472B2

(12) United States Patent
Sasahara et al.

(10) Patent No.: US 11,076,472 B2
(45) Date of Patent: Jul. 27, 2021

(54) SIGNALING LAMP MONITOR

(71) Applicant: ROHM CO., LTD., Kyoto (JP)

(72) Inventors: Tetsuya Sasahara, Kyoto (JP); Hiroshi Sekiguchi, Kyoto (JP); Ikuma Suzuki, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 16/615,713

(22) PCT Filed: Mar. 9, 2018

(86) PCT No.: PCT/JP2018/009244
§ 371 (c)(1),
(2) Date: Nov. 21, 2019

(87) PCT Pub. No.: WO2018/216311
PCT Pub. Date: Nov. 29, 2018

(65) Prior Publication Data

US 2020/0178378 A1 Jun. 4, 2020

(30) Foreign Application Priority Data

May 26, 2017 (JP) ..... JP2017-104570
Jan. 11, 2018 (JP) ..... JP2018-002509

(51) Int. Cl.
*H05B 47/21* (2020.01)
*H05B 47/19* (2020.01)
*F21S 2/00* (2016.01)

(52) U.S. Cl.
CPC ..... *H05B 47/22* (2020.01); *H05B 47/19* (2020.01); *F21S 2/00* (2013.01)

(58) Field of Classification Search
CPC ..... H05B 47/22; H05B 47/19; H05B 45/58; H05B 45/14; F21S 2/00; F21S 9/03;
(Continued)

(56) References Cited

U.S. PATENT DOCUMENTS

2010/0237695 A1* 9/2010 Covaro ..... H02J 4/00 307/19
2012/0044350 A1* 2/2012 Verfuerth ..... G06T 7/20 348/143
2013/0293112 A1* 11/2013 Reed ..... H05B 45/20 315/131

FOREIGN PATENT DOCUMENTS

JP 2001-250698 A 9/2001
JP 2003-264507 A 9/2003
(Continued)

OTHER PUBLICATIONS

Office Action received in the corresponding Japanese Patent application, dated Jun. 9, 2020, and machine translation.
(Continued)

*Primary Examiner* — Daniel D Chang
(74) *Attorney, Agent, or Firm* — Hamre, Schumann, Mueller & Larson, P.C.

(57) ABSTRACT

A signaling lamp monitor is configured to add a communication function to a signaling lamp such as a stack signaling lamp easily and at a low cost. The signaling lamp monitor includes a detector that detects light emitted from the signaling lamp, a controller that generates a detection signal at least based on the detection, and a transmitter that transmits the detection signal by wireless communication. The transmitter is provided with an antenna disposed above the detector.

9 Claims, 29 Drawing Sheets

(58) Field of Classification Search
CPC .... F21S 2/005; F21V 23/0457; F21V 23/045; F21W 2111/00
See application file for complete search history.

(56) References Cited

FOREIGN PATENT DOCUMENTS

| | | | |
|---|---|---|---|
| JP | 2004-6291 | A | 1/2004 |
| JP | 2013-12836 | A | 1/2013 |
| JP | 2014-164598 | A | 9/2014 |
| JP | 3202062 | U | 1/2016 |

OTHER PUBLICATIONS

International Search Report issued in PCT/JP2018/009244, dated May 15, 2018 (1 page).

* cited by examiner (a)

(b)

A2

(a)

(b)

(a)

(b)

(a)

(b)

SIGNALING LAMP MONITOR

TECHNICAL FIELD

The present disclosure relates to a signaling lamp monitor.

BACKGROUND ART

Stack signaling lamps or stack lights for indicating the operating state of a production apparatus to an operator are conventionally known. A stack signaling lamp has a plurality of light-emitting units. Such a stack signaling lamp receives a signal indicating the operating state from the production apparatus and causes the light-emitting units to emit light in accordance with the signal. Based on the light emission state (on, flashing, or off) or the color of the light emitted, the operator recognizes the operating state of the production apparatus.

Communicating information by the above stack signaling lamp is performed by visible light. Thus, to recognize the operating state of the production apparatus, the operator needs to be present at a location where they can see the stack signaling lamp (typically, near the stack signaling lamp or the production apparatus). Meanwhile, a system has been developed that transmits a predetermined signal to a management apparatus by incorporating a communication circuit in a stack signaling lamp (see Patent Document 1). In this case, the management apparatus recognizes the operating state of the production apparatus, so that the operator does not need to be present near the stack signaling lamp.

TECHNICAL REFERENCE

Patent Document

Patent Document 1: JP-A-2014-164598

SUMMARY OF THE INVENTION

Problems to be Solved by the Invention

In the above communication-type management system, the stack signaling lamp incorporating the communication circuit needs to be attached to the production apparatus. Thus, when a stack signaling lamp of an old type (i.e., without communication function) is already attached to the production apparatus, it needs to be replaced with a new stack signaling lamp, which is troublesome. The cost for purchasing a new stack signaling lamp is also required. On the other hand, instead of replacing the entire stack signaling lamp, incorporating a communication circuit in a stack signaling lamp of an old type may be considered. In this case, the cost can be reduced, but the troublesome work such as installing a new wiring (e.g. signal wiring or power wiring) for communication circuit may be required. In either case, it is necessary to stop the production line and perform replacement work (or installation work), which may cause problems such as a reduction of the production amount.

The present disclosure has been proposed under the above-noted circumstances. One object of the present disclosure is to provide a signaling lamp monitor that can easily add a communication function to a stack signaling lamp, for example, in a short time and at low cost.

Means for Solving the Problems

The signaling lamp monitor provided according to a first aspect of the present disclosure is used as attached to a signaling lamp that indicates information by light. The signaling lamp monitor includes a detector that detects light, a controller that generates a detection signal at least based on the detection, and a transmitter that transmits the detection signal by wireless communication. The transmitter is provided with an antenna disposed vertically above the detector.

Advantages of the Invention

According to the signaling lamp monitor having the above configuration, a detection signal is generated based on the light emitted by the signaling lamp, and the detection signal is transmitted by wireless communication. Thus, it is possible to add a communication function to a conventional signaling lamp without separately providing a wiring for inputting signals from a production apparatus or the signaling lamp.

MODE FOR CARRYING OUT THE INVENTION

Various embodiments of a signaling lamp monitor according to the present disclosure are described below with reference to the accompanying drawings.

Figure 1:
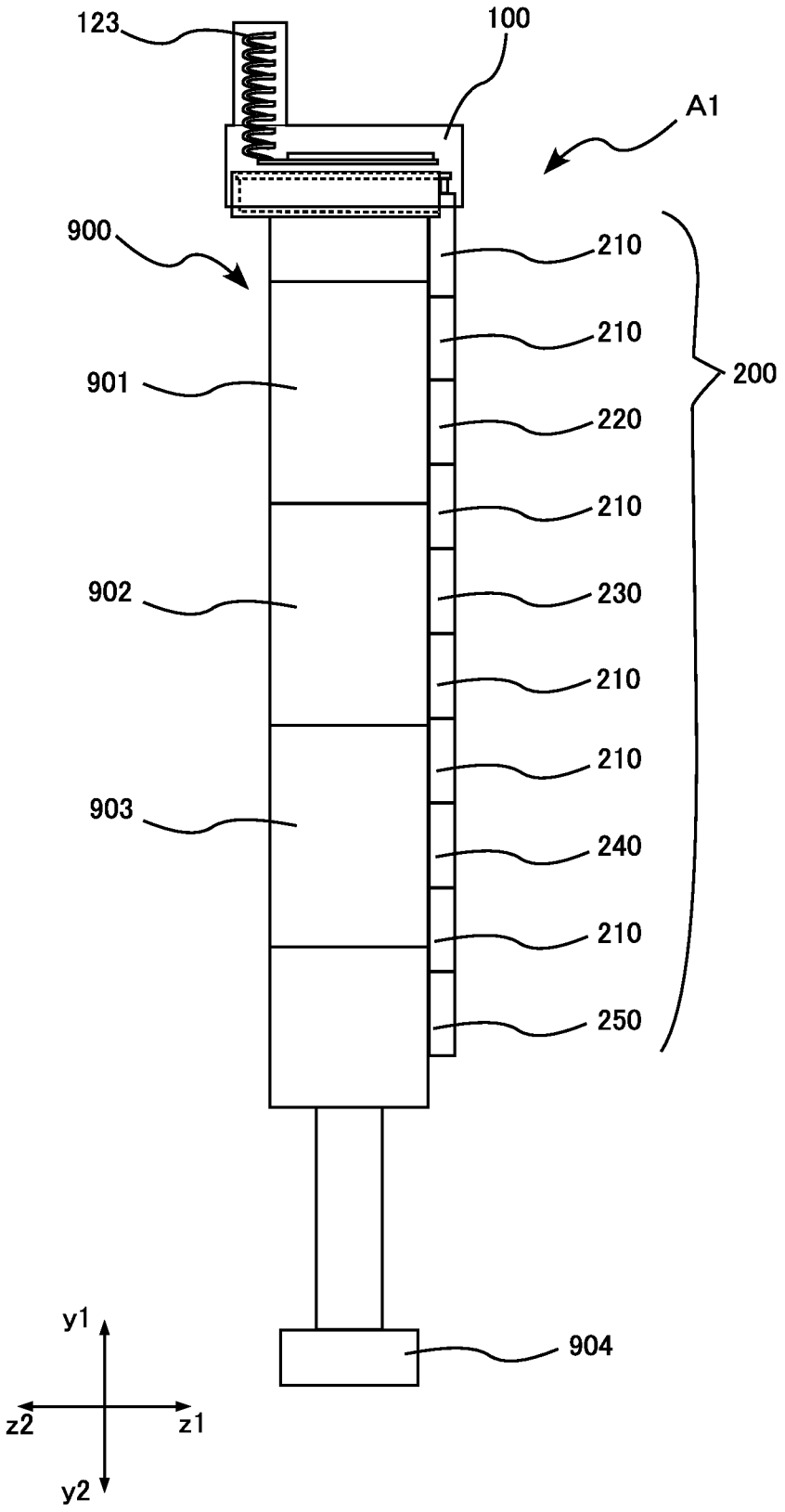
FIG. 1 is a schematic view showing a signaling lamp monitor according to a first embodiment as attached to a stack signaling lamp.
Figure 2:
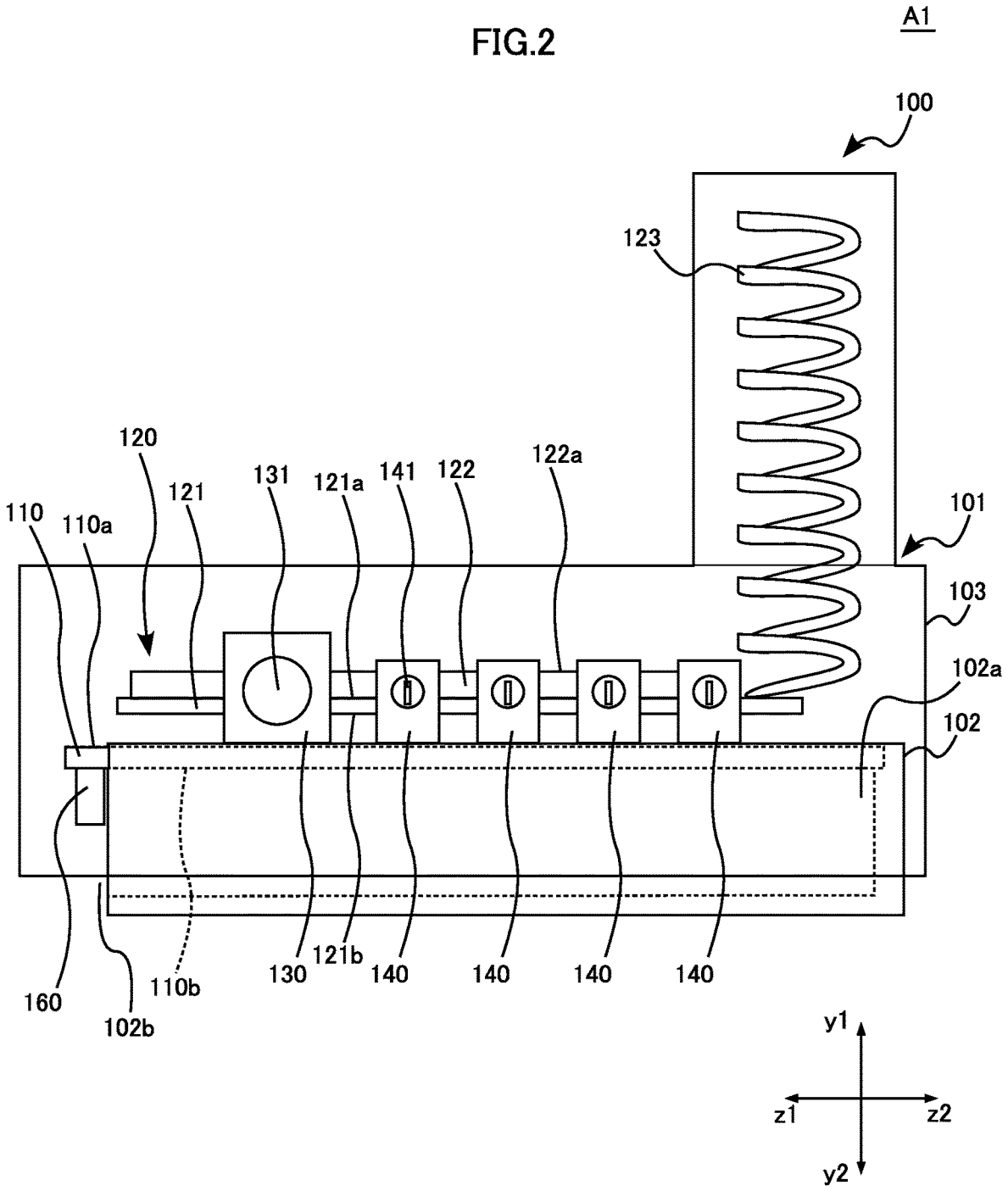
FIG. 2 is a front view of a main body of the signaling lamp monitor.
Figure 3:
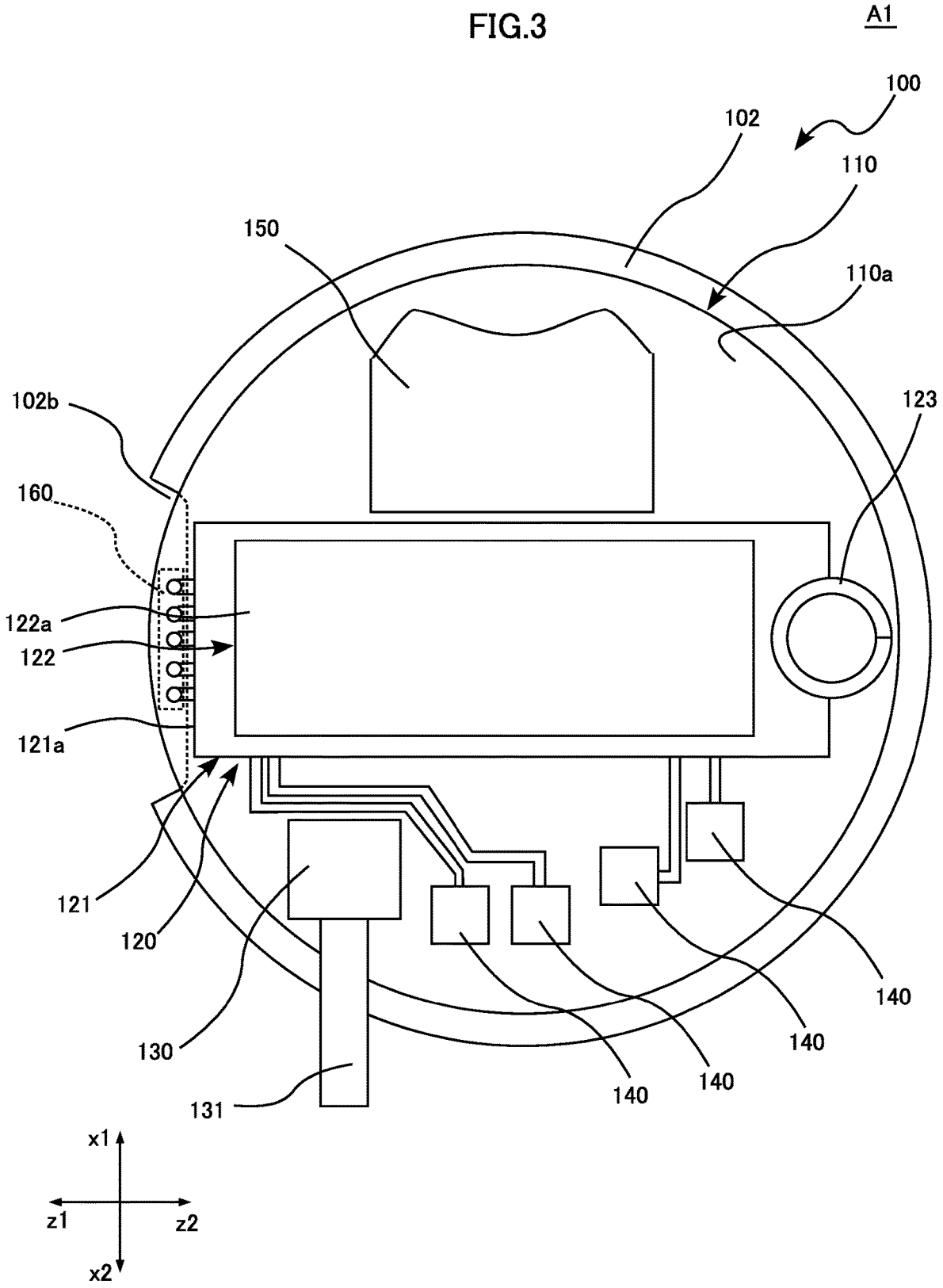
FIG. 3 is a plan view of the main body of the signaling lamp monitor.
Figure 4:
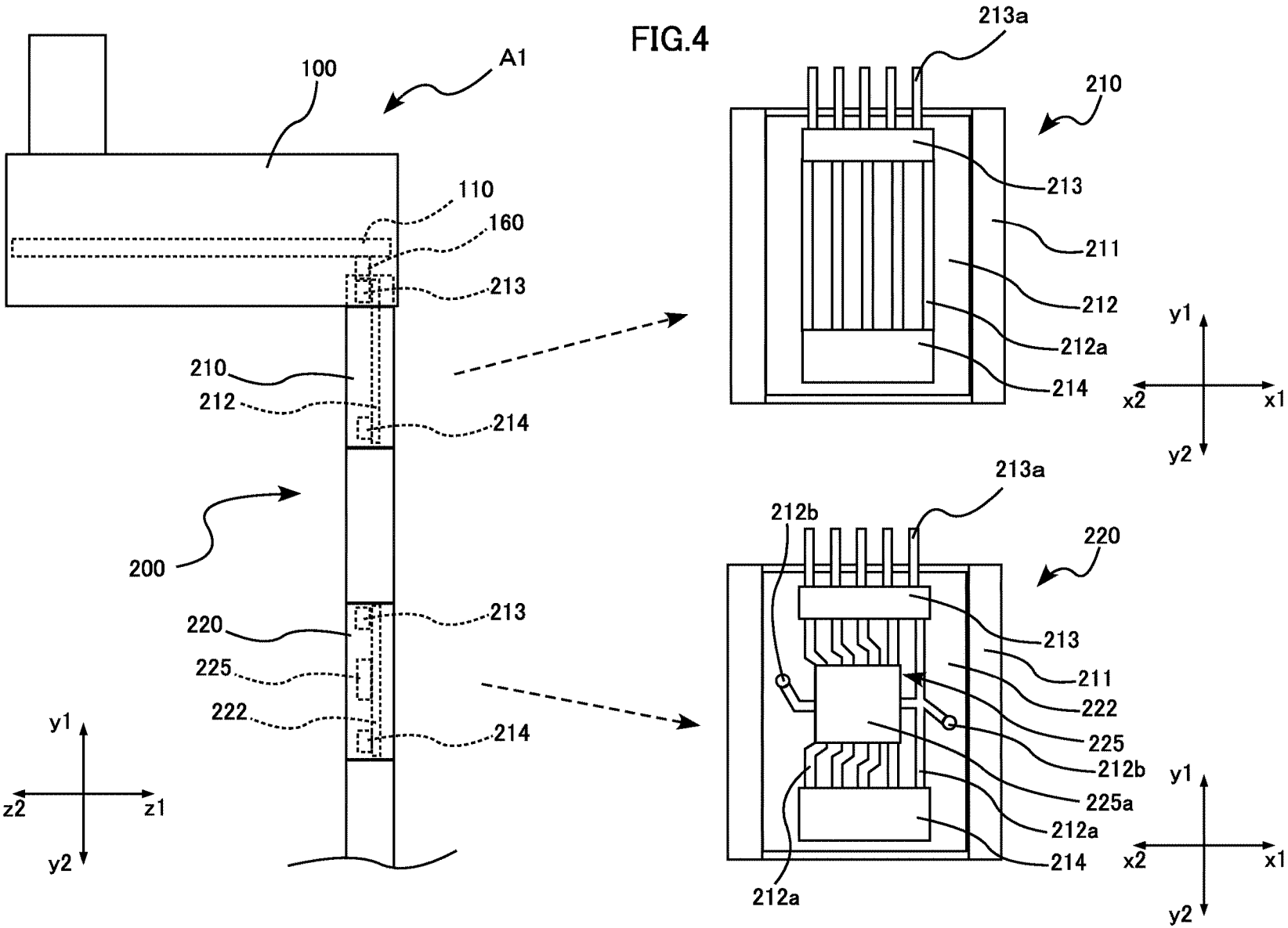
FIG. 4 is an explanatory view of a relay block and a sensor block of the signaling lamp monitor.
Figure 5:
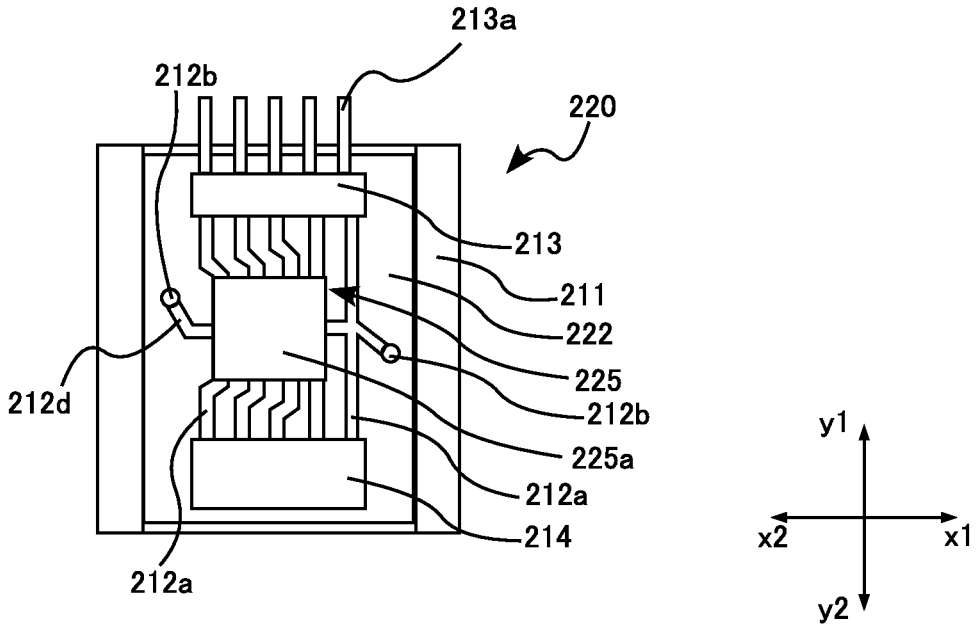
FIG. 5 is a front view (a) and a rear view (b) of the sensor block shown in FIG. 4.
Figure 5:
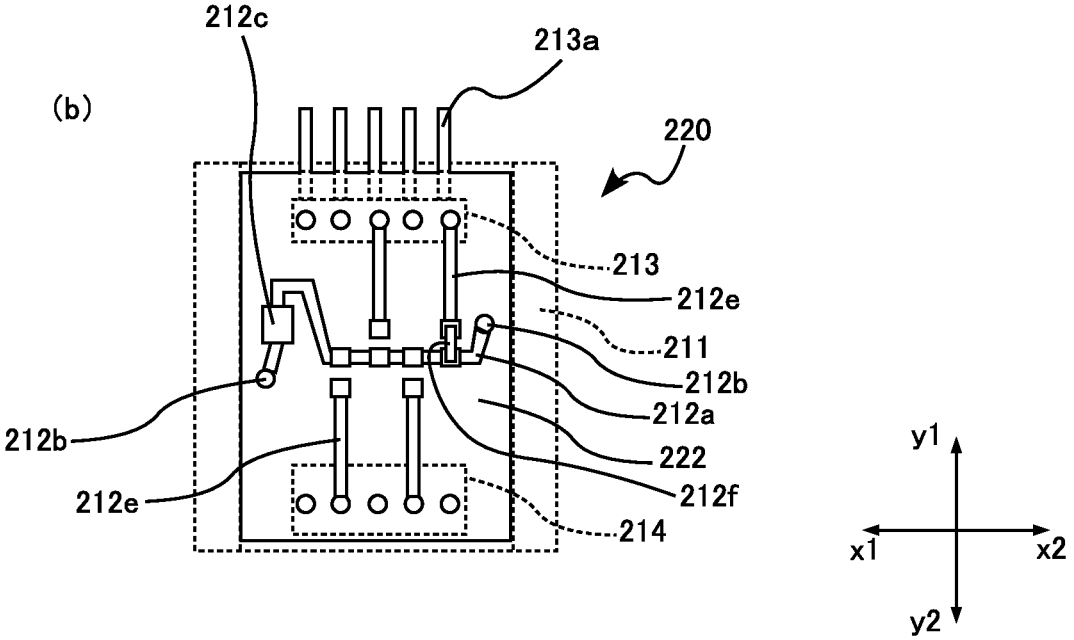
Figure 6:
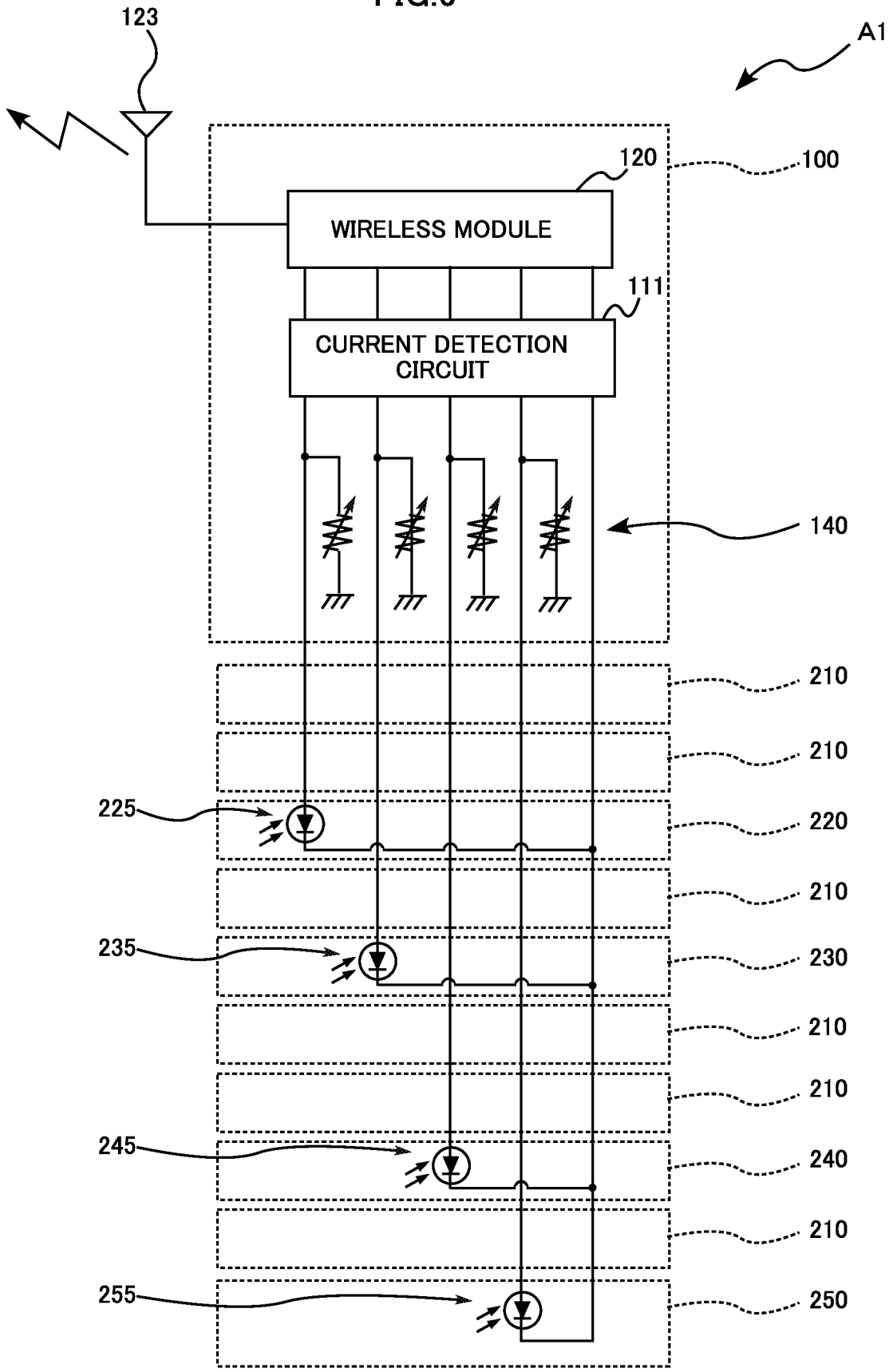
FIG. 6 illustrates the circuit configuration of the signaling lamp monitor.
Figure 7:
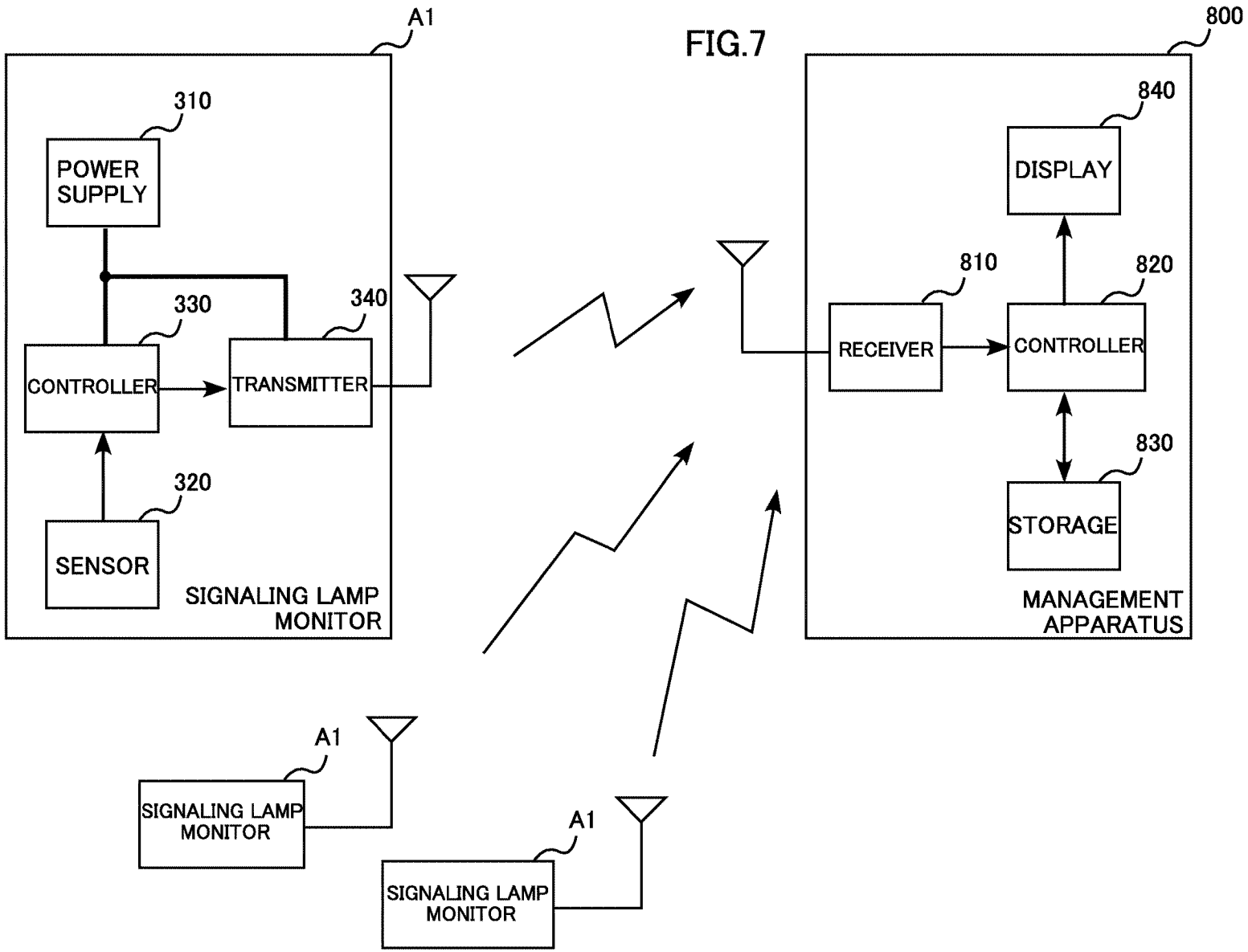
FIG. 7 is a block diagram illustrating a management system including the signaling lamp monitor.

FIGS. 1-7 are explanatory views showing a signaling lamp monitor A1 according to a first embodiment. FIG. 1 is a schematic view showing an overall configuration of the signaling lamp monitor A1 as attached to a stack signaling lamp 900. FIG. 2 is a front view of a main body of the signaling lamp monitor A1. FIG. 3 is a plan view of the main body of the signaling lamp monitor A1. FIG. 3 shows without a cover 103 (see FIG. 2). FIG. 4 is an explanatory view of a relay block and a sensor block. FIG. 5(*a*) is a front view of a sensor block, whereas FIG. 5(*b*) is a rear view of the sensor block. FIG. 6 is a schematic view showing the circuit configuration of the signaling lamp monitor A1. FIG. 7 is a block diagram of a management system including the signaling lamp monitor A1.

As shown in FIG. 1, the signaling lamp monitor A1 is used as attached to a stack signaling lamp 900. The stack signaling lamp is a signaling lamp for indicating the operating state of a production apparatus to an operator in a factory, for example. The stack signaling lamp 900 has a plurality of light emitters 901-903 stacked to form a round column and includes a mount base 904. The stack signaling lamp 900 is attached to a production apparatus by fixing the mount base 904 to the top of the production apparatus such that the light emitters 901-903 align in the vertical direction. The stack signaling lamp 900 receives a signal ("state signal") indicating the operating state from the production apparatus and causes the light emitters 901-903 to appropriately emit light in accordance with the signal. The light emitters 901, 902 and 903 may emit red light, yellow light and blue light, respectively. The operator recognizes out the operating state of the production apparatus from the light emission state (on, flashing, or off) or the color of the light emitted from the stack signaling lamp.

The signaling lamp monitor A1 includes a main body 100 and a detection unit 200. The main body 100 is placed on the top of the stack signaling lamp 900. The detection unit extends vertically downward from an end of the bottom surface of the main body 100 along the side surface of the stack signaling lamp 900. The signaling lamp monitor A1 detects the light emitted from the stack signaling lamp 900 at the detection unit 200, identifies the light emission state (on, flashing, or off) or the light emission color based on the detected light, and transmits the identification result as a radio signal. Hereinafter, the vertical direction is referred to as the y direction (y1-y2 direction), the direction from the center of the main body 100 toward the detection unit 200 within a horizontal plane is referred to as the z direction (z1-z2 direction), and the direction orthogonal to both the y direction and the z direction is referred to as the x direction (x1-x2 direction).

First, the main body 100 is described. As shown in FIGS. 2 and 3, the main body 100 includes a housing 101, a circuit board 110, a wireless module 120, a switch 130, a plurality of variable resistors 140, a battery holder 150 and a connector 160. Though not illustrated, the main body 100 may include other circuit elements as required.

The housing 101 houses the circuit board 110, the wireless module 120, the switch 130, the variable resistors 140, the battery holder 150 and the connector 160. The housing 101 includes a case 102 and a cover 103. The case 102 is made of a synthetic resin, for example, but is not limited to this. The case 102 is in the form of a bottomed cylinder with a relatively small dimension measured in a direction parallel to its central axis. The case 102 has an opening 102*a* in which the circuit board 110 is fitted. Also, a cutout 102*b* for attaching the detection unit 200 is formed at portions of the bottom surface and the side wall of the case 102. The cutout 102*b* exposes a part of the back surface 110*b* of the circuit board 110. In the present embodiment, since the detection unit 200 extends downward from the bottom of the main body 100, the diameter of the bottom surface of the case 102 (main body 100) is made larger than the diameter of the upper surface of the stack signaling lamp 900 on which it is placed (see FIG. 1). When the detection unit 200 is to be attached in other ways, the diameter of the bottom surface of the case 102 may be made smaller than that of the upper surface of the stack signaling lamp 900. Although the bottom surface of the case 102 is made circular to conform to the shape of the upper surface of the stack signaling lamp 900, the present disclosure is not limited to this. The bottom surface of the case 102 may have other shapes such as a rectangular shape.

The cover 103 serves to protect the circuit board 110 and an antenna 123, for example, and is configured to cover the case 102. A part of the cover 103 is in the form of a bottomed cylinder with a relatively small dimension measured in a direction parallel to its central axis. The cover 103 has a hollow projection for receiving the antenna 123, which is formed integrally on the cylindrical portion. The shape of the cover 103 is not limited to this example. The cover 103 is made of a synthetic resin such as acrylic resin, for example. The cover 103 is configured to transmit light to allow a solar battery 122 (described later) to receive light. The cover 103 may be made of an opaque material when it does not contain the solar battery 122.

The circuit board 110 is made up of a substrate made of an insulating material such as glass epoxy resin and a wiring pattern formed on the substrate. The circuit board 110 is circular and has a front surface 110*a* and a back surface 110*b*. The front surface 110*a* and the back surface 110*b* face opposite to each other in the thickness direction (y direction) of the circuit board 110. The wireless module 120, the switch 130, the variable resistors 140 and the battery holder 150 are mounted on the front surface 110*a*. As shown in FIG. 3, the wireless module 120 is elongate along the z direction and arranged such that its center coincides with the center of the front surface 110*a*. On the x2 side of the wireless module 120 are arranged the switch 130 and the variable resistors 140. On the x1 side of the wireless module 120 is arranged the battery holder 150. With such an arrangement, the diameter of the circuit board 110 is made close to the dimension of the wireless module 120 in the longitudinal direction. Note that the arrangement of each component is not limited to this example. As shown in FIG. 2, the wireless module 120 is spaced apart from the circuit board 110. This allows a circuit element, for example, to be disposed also between the wireless module 120 and the circuit board 110. A connector 160 is mounted on the back surface 110*b*. In the illustrated example, the connector 160 is disposed adjacent to an edge of the circuit board 110. However, the present disclosure is not limited to this. The circuit board 110 is fitted in the opening 102*a*, with the back surface 110*b* facing inside the case 102, and fixed to the case 102 with a screw, for example. Thus, while the front surface 110*a* of the circuit board 110 is exposed from the case 102, most of the back surface 110*b* is hidden in the case 102. A current detection circuit 111 (see FIG. 6) and other circuit elements are also mounted to the circuit board 110. The components that do not require direct operation or visual check by an operator may be mounted on the back surface 110*b*.

In the present embodiment, the wireless module 120 performs communication conforming to the EnOcean communication standard that employs battery-less wireless transmission technology. The wireless module 120 includes a module board 121, the solar battery 122 and the antenna 123. The module board 121 has a substrate made of an insulating material such as glass epoxy resin and a wiring pattern formed on the substrate. The module board 121 is in the form of a rectangular plate and has a front surface 121*a* and a back surface 121*b*. The solar battery 122 and the antenna 123 are mounted on the front surface 121*a*. Circuit elements or a CPU constituting various circuits, electronic components such as a memory, and a capacitor for storing electric power generated by the solar battery 122 are mounted on the back surface 121*b*. Examples of the various circuits include a communication circuit, a control circuit and a voltage conversion circuit. The solar battery 122 is disposed such that its surface opposite to the light-receiving surface 122*a* faces the module board 121. The solar battery 122 generates electric power from the light received at the light-receiving surface 122*a*. The antenna 123 is a normal-mode helical antenna made of a conductive wire wound into a helix and disposed on the front surface 121*a* of the module board 121 such that its central axis is parallel to the y direction. In the illustrated example, the lower end of the antenna 123 is arranged adjacent to an edge of the module board 121. The antenna 123 may have other structures such as a monopole antenna. The wireless module 120 is fixed to the circuit board 110, with the back surface 121*b* of the module board 121 facing the circuit board 110 and spaced apart from the circuit board 110. The wireless module 120 is capable of performing wireless communication using electric power generated by the solar battery 122 (or the electric power charged in the capacitor). For this purpose, the wireless module 120 incorporates a radio circuit with extremely low power consumption.

The communication standard for the wireless module 120 is not limited to the EnOcean communication standard. For example, communication conforming to Bluetooth (registered trademark), ZigBee (registered trademark), UWB (Ultra Wide Band), Z-Wave, Wi-Fi (Wireless Fidelity) or Wi-SUN (registered trademark) may be performed.

As shown in FIG. 6, the variable resistors 140 are connected in series to the photodiodes 225 etc., respectively, and individually adjust the sensitivity of the photodiodes 225 etc. by changing their resistances. The resistance of each variable resistor 140 may be changed by inserting an end of a flathead screwdriver into an adjustment groove 141 (see FIG. 2) and turning the groove. By changing the resistance, the current flowing through the photodiodes 225 etc. changes, whereby the sensitivity is adjusted. The variable resistors 140 are arranged such that their adjustment grooves 141 are oriented in the same direction.

The battery holder 150 is a holder for mounting an auxiliary battery (e.g. lithium battery). The auxiliary battery supplies electric power when neither the power generation by the solar battery 122 nor the power supply from the capacitor is performed. Thus, power is not normally supplied from the auxiliary battery.

The switch 130 is for operating the signaling lamp monitor A1. For example, the switch 130 is used to transmit various types of data or the signals related to the state of the signaling lamp monitor A1. As shown in FIG. 3, the switch 130 is provided with a push button 131 having a columnar shape, for example. In the example shown in the figure, the push button 131 is elongate in the direction (x2 direction) orthogonal to the longitudinal direction of the wireless module 120. When the push button 131 is pushed, the switch 130 outputs an operation signal to the control circuit of the wireless module 120. In response to the operation signal, the control circuit may read out predetermined data or detect the state of the signaling lamp monitor A1 to generate a predetermined signal. The generated signal is transmitted to a management apparatus 800 (see FIG. 7) via a communication circuit of the wireless module 120. As an example, when the switch 130 is pressed, the presence or absence of a battery in the battery holder 150 and the voltage are detected, and a signal corresponding to the determination result is transmitted to the management apparatus 800.

The connector 160 is a connector for connecting the detection unit 200 to the main body 100. The connector 160 have five female terminals, for example. Each of the female terminals is electrically connected to the wiring pattern of the circuit board 110. The connector 160 is disposed at the end in the z1 direction of the back surface 110*b* of the circuit board 110. The case 102 has the cutout 102*b* on the z1 side. Thus, the connector 160 is not covered with the case 102 but exposed. The connector 160 is arranged such that its opening for receiving male terminals is oriented in the y2 direction.

As shown in FIG. 1, the detection unit 200 includes a plurality of relay blocks 210 and sensor blocks 220, 230, 240 and 250.

The relay blocks 210 connect the sensor blocks 220, 230, 240 and 250 to the main body 100. As shown in FIG. 4, each of the relay blocks 210 includes a case 211, a relay board 212 and connectors 213 and 214. The case 211 is made of a synthetic resin, for example. In the present embodiment, the case 211 is made of a synthetic resin (e.g. ABS resin) containing an additive for reducing light transmission, and its inner surfaces are colored black to shield light. In the present embodiment, to enhance the light-shielding performance of the case 211, an additive is added and also the inner surfaces are colored. However, only one of these measures may be taken. The cross section (i.e., the cross section orthogonal to the y direction) of the case 211 is a U-shape (i.e., a shape having a relatively long bottom side and two sides standing from opposite ends of the bottom side). The relay board 212 is disposed inside the case 211 having the U-shaped cross section. The relay board 212 has a substrate made of an insulating material such as glass epoxy resin and a wiring pattern 212*a* formed on the substrate. In the present embodiment, the wiring pattern 212*a* is made up of five conductive linear parts (212*a*), though the present disclosure is not limited to this. The relay board 212 is fixed to the case 211, with the surface formed with the wiring pattern (conductive linear parts) 212*a* facing outward. The connector 213 is a connector for connection to the connector 160 of the main body 100, to the connector 214 of another relay block 210, or to the connector 214 of the sensor block 220, 230, 240 or 250. The connector 213 is provided with five male terminals 213*a*, and each of the male terminals 213*a* is electrically connected to one of the five conductive linear parts 212*a*. The connector 214 is a connector for connection to the connector 213 of another relay block 210 or the sensor block 220, 230, 240 or 250. The connector 214 is provided with five female terminals, and each of the female terminals is electrically connected to one of the five conductive linear parts 212*a*. That is, each male terminal 213*a* of the connector 213 is electrically connected to one of the female terminals of the connector 214.

As shown in FIGS. 4 and 5, the sensor block 220 includes a case 211, a sensor board 222 and connectors 213 and 214. The case 211 of the sensor block 220 has the same configuration as that of the case 211 of the relay block 210. As with the relay board 212 of the relay block 210, the sensor board 222 has a substrate made of an insulating material such as glass epoxy resin and a wiring pattern 212*a* formed on the substrate. As for these members (i.e., the case, the sensor board and the connector), other sensor blocks 230, 240 and 250 have the same configuration as the sensor block 220. However, the sensor block 250 does not have a connector 214, and the five terminal ends of the wiring pattern are connected to each other (see FIG. 6).

As shown in FIG. 6, the sensor blocks 220, 230, 240 and 250 are provided with photodiodes 225, 235, 245 and 255, respectively. In each sensor block, the photodiode 225, 235, 245 or 255 is mounted on the sensor board 222, and the wiring pattern 212*a* is electrically connected to the photodiode to constitute a predetermined current path. As will be understood from FIG. 6, the current path constituted of the wiring pattern 212*a* may differ among the sensor blocks. As a result, for example, the photodiode 225 of the sensor block 220 is connected to the current detection circuit 111 of the main body 100 via the leftmost conduction path and the rightmost conduction path, whereas the photodiode 235 of the sensor block 230 is connected to the current detection circuit 111 via the second conduction path from the left and the rightmost conduction path. Such a difference in the current paths can be provided by appropriately differentiating the connection state of the wiring pattern 212*a* among the sensor blocks.

As an example, FIGS. 5(*a*) and (*b*) show details of the wiring pattern 212*a* in the sensor block 220 (and hence, in other sensor blocks). In FIG. 5(*b*), the case 211 is shown by dashed lines, and the configuration seen through the case is shown. Note that the wiring pattern 212*a* shown in FIG. 5 may contain a path that will not be actually used (i.e., no current will flow), and it is only necessary to modify the wiring pattern 212*a* as required (by appropriately bridging certain portions in each sensor block with solder, for example) so as to constitute the circuit shown in FIG. 6.

Specifically, as shown in FIG. 5(*a*), the front surface of the sensor board 222 is formed with five conductive linear parts each extending in the y direction. In the illustrated example, the two on the right are generally straight, whereas the three on the left are partially bent (for the convenience of wiring, for example). Also, the four on the left partially overlap with the photodiode 225 but are electrically insulated from the photodiode 225. The connectors 213 and 214 of the sensor block 220 have the same configuration as the connectors 213 and 214 of the relay blocks 210. That is, in the sensor block 220, each male terminal 213*a* of the connector 213 is electrically connected to one of the female terminals of the connector 214 via a relevant one of the conductive linear parts. The photodiode 225 has a light-receiving surface 225*a* that faces opposite to the sensor board 222 (i.e., faces away from the sensor board 222).

In the sensor block 220, the rightmost conductive linear part has a first extension extending to the left from the straight portion and a second extension extending to the right from the straight portion. In the illustrated example, the first extension extends perpendicular to the straight portion of the conductive linear part, whereas the second extension extends diagonally downward from the straight portion, though the present disclosure is not limited to this. The first extension on the left is connected to the first terminal (now shown) formed on the back surface of the photodiode 225. The second extension on the right is connected to the wiring pattern 212*a* formed on the back surface of the sensor board 222 via a first through-hole 212*b* (the through-hole on the right in FIG. 5(*a*)).

On the back surface of the sensor board 222, the first through-hole 212*b* (the through-hole on the left in FIG. 5(*b*)) is connected to a left terminal (now shown) formed on the back surface of the photodiode 225 via a protective element 212*c* and a second through-hole 212*b* (the through-hole on the right in FIG. 5(*b*)), as shown in FIG. 5(*a*). In the example shown in FIG. 5(*a*), between the second through-hole 212*b* and the photodiode 225 is formed a conducive connecting part 212*d* having a bent shape, and the second through-hole 212*b* and the photodiode 225 are electrically connected to each other via the conductive connecting part.

As shown in FIG. 5(*b*), the back surface of the sensor board 222 is formed with four conductive strips 212*e* each extending in the y direction. In the figure, the rightmost conductive strip 212*e* has an upper end connected to the rightmost male terminal 213*a*. The second conductive strip 212*e* counted from the right has a lower end connected to the second female terminal counted from the right. The third conductive strip 212*e* counted from the right has an upper end connected to the third male terminal 213*a* counted from the right. The fourth conductive strip 212*e* counted from the right has a lower end connected to the fourth female terminal counted from the right. Also, in the sensor block 220, the lower end of the rightmost conductive strip 212*e* is electrically connected to a horizontal straight part of the wiring pattern 212*a* via a bridge part 212*f* made of an electrically conductive material (e.g. solder). As will be understood from the circuit diagram of FIG. 6, the position where the bridge part 212*f* is formed differ among the sensor blocks 220, 230, 240 and 250.

As described above, the wiring pattern 212*a* on the back surface shown in FIG. 5(*b*) is connected to one of the male terminals 213*a* or the female terminals. The terminal to which the wiring pattern is connected differs among the sensor blocks 220, 230, 240 and 250. With such an arrangement, the circuit configuration shown in FIG. 6 can be realized by preparing a plurality of sensor blocks having a same configuration and later forming bridge parts 212*f* at appropriate positions.

As shown in FIG. 1, in the detection unit 200, the sensor blocks 220, 230, 240 and 250 are connected to each other via six relay blocks 210. Specifically, from top to bottom, the first relay block 210, the second relay block 210, the first sensor block 220, the third relay block 210, the second sensor block 230, the fourth relay block 210, the fifth relay block 210, the third sensor block 240, the sixth relay block 210 and the fourth sensor block 250 are connected. The first relay block 210 is connected directly (i.e., without the interposition of other relay blocks or sensor blocks) to the main body 100. By placing the main body 100 on the top of the stack signaling lamp 900, the detection unit 200 extending downward from the bottom surface of the main body 100 is arranged along the side surface of the stack signaling lamp 900. The positions of the sensor blocks 220, 230 and 240 in the y direction correspond to the positions of the light emitters 901, 902 and 903, respectively. Also, as shown in FIG. 4, the photodiode (225 etc.) of each sensor block (220 etc.) is oriented such that the light-receiving surface (225*a* etc.) faces in the z2 direction. Thus, each photodiode is capable of receiving the light emitted from the light emitter (901 etc). The present embodiment employs photodiodes as a detector or a light receiver, though the present disclosure is not limited to this. For example, photo transistors may be used instead of photodiodes.

As shown in FIG. 6, the photodiodes 225, 235, 245 and 255 of the sensor blocks 220, 230, 240 and 250 are connected in series to the variable resistors 140 and connected to the current detection circuit 111 in parallel to each other. The current detection circuit 111 detects the voltage across the terminals of each variable resistor 140 to detect the current flowing through each photodiodes 225, 235, 245, 255 and outputs a current signal to the wireless module 120. Based on the inputted current signal, the wireless module 120 determines the light emission state (on, flashing, or off) of each light emitter of the stack signaling lamp 900. Note that, in the example shown in FIG. 1, since only three light emitters are provided, the photodiode 255 does not operate, and the sensor block 250 is used merely to realize the connection through the entire signaling lamp monitor A1.

Specifically, the wireless module 120 detects the light emission state of the light emitter 901 based on the current flowing through the photodiode 225, detects the light emission state of the light emitter 902 based on the current flowing through the photodiode 235, and detects the light emission state of the light emitter 903 based on the current flowing through the photodiode 245. The wireless module 120 generates detection signals based on these detection results and transmits the detection signals via the antenna 123. Although the current detection circuit 111 is provided separately from the wireless module 120 in the example shown in FIG. 6, the wireless module 120 itself may detect the current.

FIG. 7 is a functional block diagram illustrating a management system using the signaling lamp monitor A1. In the figure, the signaling lamp monitor A1 includes a power supply 310, a sensor 320, a controller 330 and a transmitter 340. The power supply 310 supplies electric power to the controller 330 and the transmitter 340. The solar battery 122 and the capacitor of the wireless module 120, an auxiliary battery mounted to the battery holder 150, and the voltage conversion circuit in the module board 121 correspond to the power supply 310. The sensor 320 detects the light emitted from the stack signaling lamp 900 and inputs it to the controller as a current signal. The detection unit 200, the variable resistors 140 and the current detection circuit 111 correspond to the sensor 320. The controller 330 generates a detection signal based on the current signal inputted from the sensor 320 and transmits the detection signal to the transmitter 340. The control circuit provided on the module board 121 corresponds to the controller 330. The transmitter 340 receives a detection signal from the controller 330 and transmits the signal by wireless communication. The communication circuit provided on the module board 121 and the antenna 123 correspond to the transmitter 340.

The controller 330 identifies the color of the emitted light based on the current signal inputted from the sensor 320. The controller 330 identifies which of the light emitters 901, 902 and 903 emits light based on in which sensor block 220, 230, 240 or 250 (which may differ from each other in light emission color) the current flows through the photodiode. In the present embodiment, when the current flows through the photodiode 225 of the sensor block 220, it is determined that the light emitter 901 (red) emits light. When the current flows through the photodiode 235 of the sensor block 230, it is determined that the light emitter 902 (yellow) emits light. When the current has flowed through the photodiode 245 of the sensor block 240, it is determined that the light emitter 903 (blue) emits light.

The controller 330 identifies the light emission state (on, flashing, or off) based on the current signal inputted from the sensor 320. Generally, the measurement for identifying the light emission state is performed a plurality of times, and the time taken for each measurement (measurement time) is set appropriately. As an example, when the current flow continues (i.e., the photodiode continues to receive light) for the measurement time (e.g. for three seconds), the controller 330 identifies the light emission state as "on" state. On the other hand, when the condition where no current flows (i.e., the photodiode receives no light) continues for the measurement time, the controller 330 identifies the light emission state as "off" state. When the condition where the current flows and the condition where no current flows alternate, the controller 330 identifies the light emission state as "flashing" state.

In the case where the light emission state does not change between the previous measurement and the present measurement, a predetermined downtime (e.g. seven seconds) is provided after the completion of the present measurement. Thus, in the case where the light emission state does not change for a relatively long time, the controller 330 performs measurement (more precisely, starts measurement) each time a predetermined time period (a single measurement time plus a single downtime; e.g. 10 seconds) lapses.

On the other hand, in the case where the light emission state changes between the previous measurement and the present measurement, the next measurement is started immediately without a downtime. Based on the light emission state identified by such measurement, the controller 330 generates (and transmits) a detection signal. Such an arrangement allows a detection signal to be generated within a short time (e.g. approximately 3 to 13 seconds) after the light emission state changes.

As described above, in the present embodiment, the timing to start measurement (first timing) differs between the case where the light emission state is changed and the case where it is unchanged, though the present disclosure is not limited to this.

As described above, when the light emission state does not change, the controller 330 performs the next measurement after a predetermined downtime. When the instance where the light emission state does not change occurs a predetermined consecutive number of times (the number of state-unchanged times), the controller 330 generates a detection signal based on the light emission state identified by the last measurement. That is, even when the light emission state does not change continuously, the controller 330 generates a detection signal based on predetermined conditions. The timing to generate a detection signal (second timing) in the case where the light emission state does not change is determined based on the measurement time, the downtime and the number of state-unchanged times. For example, when the measurement time is three seconds, the downtime is seven seconds, and the number of state-unchanged times is three, the second timing is every 30 seconds.

In the present embodiment, the second timing (the detection signal generation timing) differs between the case where the light emission state is changed and the case where it is unchanged. As described above, in the case where a change in the light emission state is detected, a detection signal is generated based on the measurement result immediately after such detection. In the case where the light emission state does not change, a detection signal is generated after the measurement is performed a predetermined number of times. Of course, the present disclosure is not limited to this. For example, the detection signal may be generated at regular time intervals regardless of whether the light emission state changes or does not change.

The detection signal may contain a plurality of types of information. For example, the detection signal of the present embodiment contains information for identifying the signaling lamp monitor A1, information indicating the light emission color, and information indicating the light emission state. The information for identifying the signaling lamp monitor A1 may be a unique number assigned to (stored in) the signaling lamp monitor A1 in advance, which may be the MAC address or ID number of the wireless module 120. The information indicating the light emission color is the information for the detection signal to indicate which color of light is emitted (i.e., by which of the sensor blocks 220, 230, 240, 250 it is detected). The information indicating the light emission state is the information indicating which one of "on" state, "off" state and "flashing" state the light emission state is. In the case of the "flashing" state, the information indicating the flashing rate (flashing frequency) may be contained. The information indicating the light emission state may be "00" in the case of "off", "04" in the case of "on" and "01", "02", "03" in accordance with the flashing frequency in the case of "flashing".

The controller 330 causes the transmitter 340 to transmit the generated detection signal by wireless communication. The electric power required at the time is supplied from the power supply 310 to the transmitter 340 under control by the controller 330. After the transmitter 340 transmits the detection signal by wireless communication, the controller 330 stops the power supply from the power supply 310 to the transmitter 340.

Figure 8:
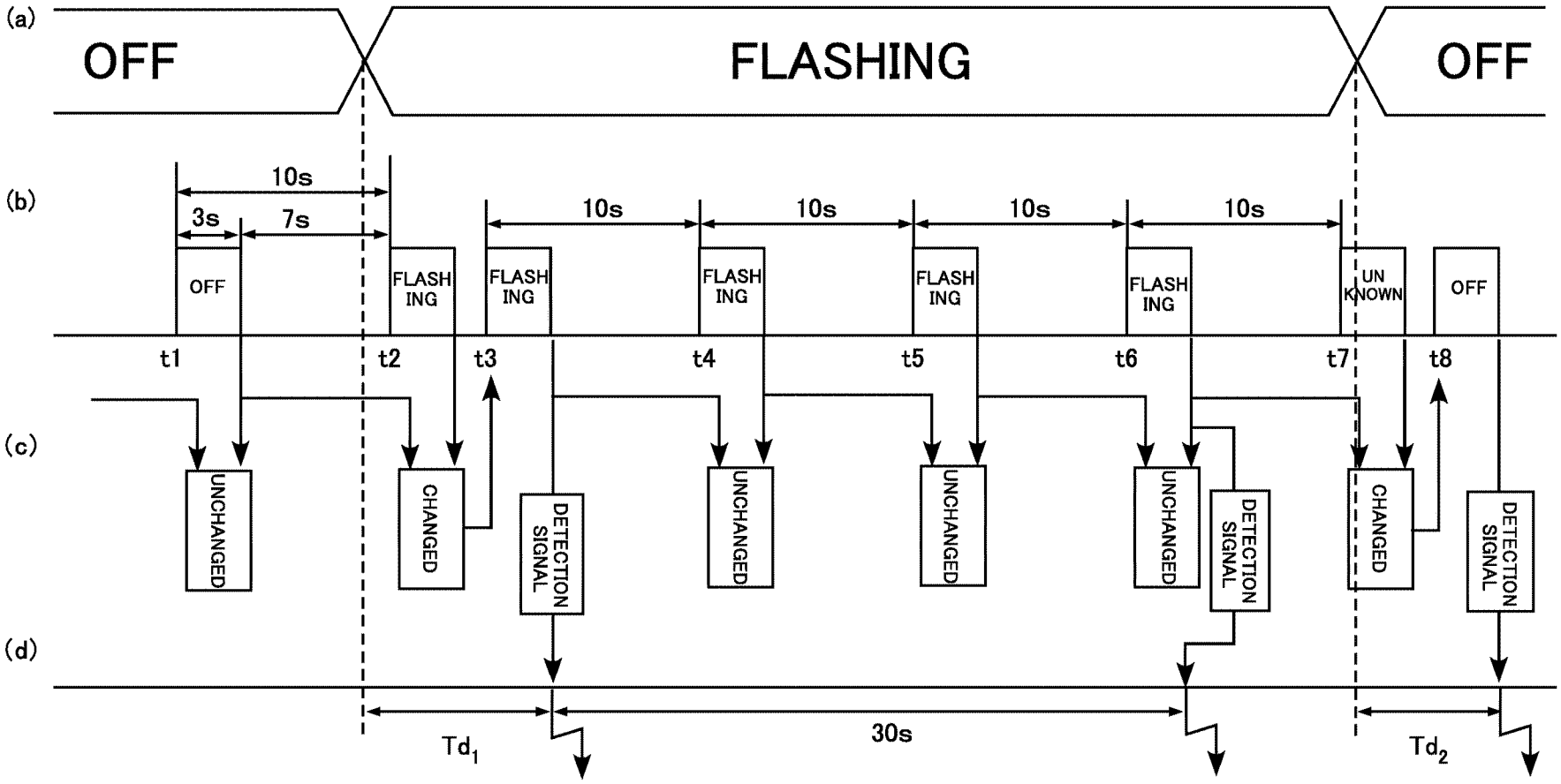
FIG. 8 is a sequence diagram for describing the measurement and detection signal generation by a controller.

FIG. 8 is a sequence diagram for describing the measurement and detection signal generation by the controller 330. In the figure, (a) shows an example of the light emission state of one of the light emitters of the stack signaling lamp 900. In the figure, (b) shows the light emission state measured and identified by the controller 330. In the figure, (c) shows the results of comparison performed based on the light emission state identified by the controller 330. In the figure, (d) shows the transmission state of the detection signal generated based on the results of comparison by the controller 330.

First, measurement is started at time t1. For convenience of explanation, this measurement is referred to as "first" measurement. Three seconds after time t1, the measurement result of the first measurement is obtained. In the illustrated example, the light emission state is identified as "off" state. This identification result is compared with the identification result of the previous measurement (assumed as "off" state, for example), and the light emission state is determined to be "unchanged".

Then, after the lapse of the first downtime (e.g. seven seconds), the second measurement is performed at time t2. From the measurement result, the light emission state is identified as "flashing" state. This identification result is compared with that of the first measurement (i.e., the "off" state), and the light emission state is determined to be "changed". At time t3 immediately after this determination, the third measurement is performed. From the measurement result, the light emission state is identified as "flashing" state. Based on this light emission state ("flashing" state), a detection signal is generated and transmitted. The actual light emission state of the stack signaling lamp 900 (see FIG. 8(*a*)) has been changed from the "off" state to the "flashing state" between time t1 and time t2. That is, there is a time difference $Td_1$ between the actual change time and the detection signal transmission. The time difference $Td_1$ is the sum of (i) the time from the actual change to time t2, (ii) the total of the two measurement time (e.g. six seconds), and (iii) the time from the completion of the second measurement till the start of the third measurement. Note however that the time (iii) described above is very short so that the detection signal is generated (and transmitted) substantially after the lapse of the total time of the above (i) and (ii) (e.g. approximately 6 to 13 seconds).

Then, at time t4 after the lapse of the second downtime, the fourth measurement is performed, and the light emission state is identified as "flashing" state. This identification result is compared with that of the third measurement (i.e., the "flashing" state), and the light emission state is determined to be "unchanged". At time t5 after the lapse of a third downtime, the fifth measurement is performed, and the same determination is made.

Then, at time t6 after the lapse of the fourth downtime, the sixth measurement is performed. From the measurement result, the light emission state is identified as "flashing" state. Thus, at this stage again, the light emission state is "unchanged". Since the light emission state is determined to be "unchanged" three times in a row in the measurements at time t4, time t5 and time t6, the detection signal is generated and transmitted based on the determination result of the measurement started at time t6 (i.e., "flashing" state). In this way, when the light emission state does not change, the detection signal is transmitted each time a predetermined time (30 seconds in the illustrated example) lapses.

Then, at time t7 after the lapse of the fifth downtime, the seventh measurement is performed. At this time, the measurement time overlaps with the timing of actual change of the light emission state (see FIG. 8(*a*), (*b*)), so that the time required for identification of the light emission state is not secured. This hinders the identification of the light emission state from the measurement result, so that the result is the "unknown" state. In this case, in the comparison with the identification result ("flashing" state) of the sixth measurement, the light emission state is determined to be "changed". At time t8 immediately after this determination, the eighth measurement is performed, and from the measurement result, the light emission state is identified as "off" state. Based on this light emission state ("off" state), a detection signal is generated and transmitted. The actual light emission state of the stack signaling lamp 900 has been changed from the "flashing" state to the "off" state between time t7 and the time when the eighth measurement completes. The time difference $Td_2$ from the actual change to the detection signal transmission is approximately 3 to 6 seconds, for example.

The sequence of measurement and generation of detection signals by the controller 330 is not limited to that described above. For example, instead of performing the measurement periodically, the measurement may be performed when the photodiode 225 etc. receives light.

As shown in FIG. 7, the management system may include a plurality of signaling lamp monitors A1 along with the management apparatus 800. The management system is a system that centrally manages the operating state of each of a plurality of production apparatuses in a factory, for example. Each signaling lamp monitor A1 is installed on the stack signaling lamp 900 attached to a production apparatus. In each signaling lamp monitor A1, the detection signal generated by the controller 330 is transmitted by the transmitter 340 by wireless communication. The management apparatus 800 includes a receiver 810, a controller 820, a storage 830 and a display 840. The receiver 810 receives detection signals transmitted from respective signaling lamp monitors A1 and outputs them to the controller 820. The controller 820 stores the information contained in the inputted detection signals in the storage 830. The controller 820 causes the display 840 to display the information stored in the storage 830 in accordance with a program or an operation by an operator. The management apparatus 800 may be a unitary apparatus incorporating the receiver 810, the controller 820, the storage 830 and the display 840. Alternatively, it may be a system in which a general purpose computer that functions as the controller 820 and the storage 830 by executing programs is connected, via a local area network or the Internet, to a receiving device arranged proximate to each signaling lamp monitor A1 to function as the receiver 810. Also, unlike the present embodiment, the stack signaling lamp itself may incorporate a communication circuit.

Next, the process for assembling and attaching the signaling lamp monitor A1 is described.

First, the detection unit 200 is assembled in accordance with the light emission positions of the stack signaling lamp 900. Specifically, the same number of (or at least the same number of) sensor blocks as the number of the light emitters of the stack signaling lamp 900 are prepared. These sensor blocks and a necessary number of relay blocks are connected end-to-end to provide the detection unit 200. In the example shown in FIG. 1, the detection unit 200 is assembled such that light emitted from the three light emitters 901, 902 and 903 of the stack signaling lamp 900 are received at the three sensor blocks 220, 230 and 240 (three photodiodes 225, 235 and 245). As shown in FIG. 4, each of the sensor blocks 220, 230, 240 and 250 is connected, with the connector 213 arranged on the y1 side and the connector 214 on the y2 side. In assembling the detection unit 200, the number of the relay blocks 210 may be adjusted in accordance with the dimension of the light emitters 901 of the stack signaling lamp 900 in the vertical direction. For example, in the example shown in FIG. 9(*a*), two adjacent sensor blocks (220 and 230; 230 and 250) are connected by a single relay block 210. Further, another relay block 210 is used to connect the uppermost sensor block 220 and the main body 100. In this way, the signaling lamp monitor A1 is completed. In this example, the sensor block 240 is not used.

Figure 9:
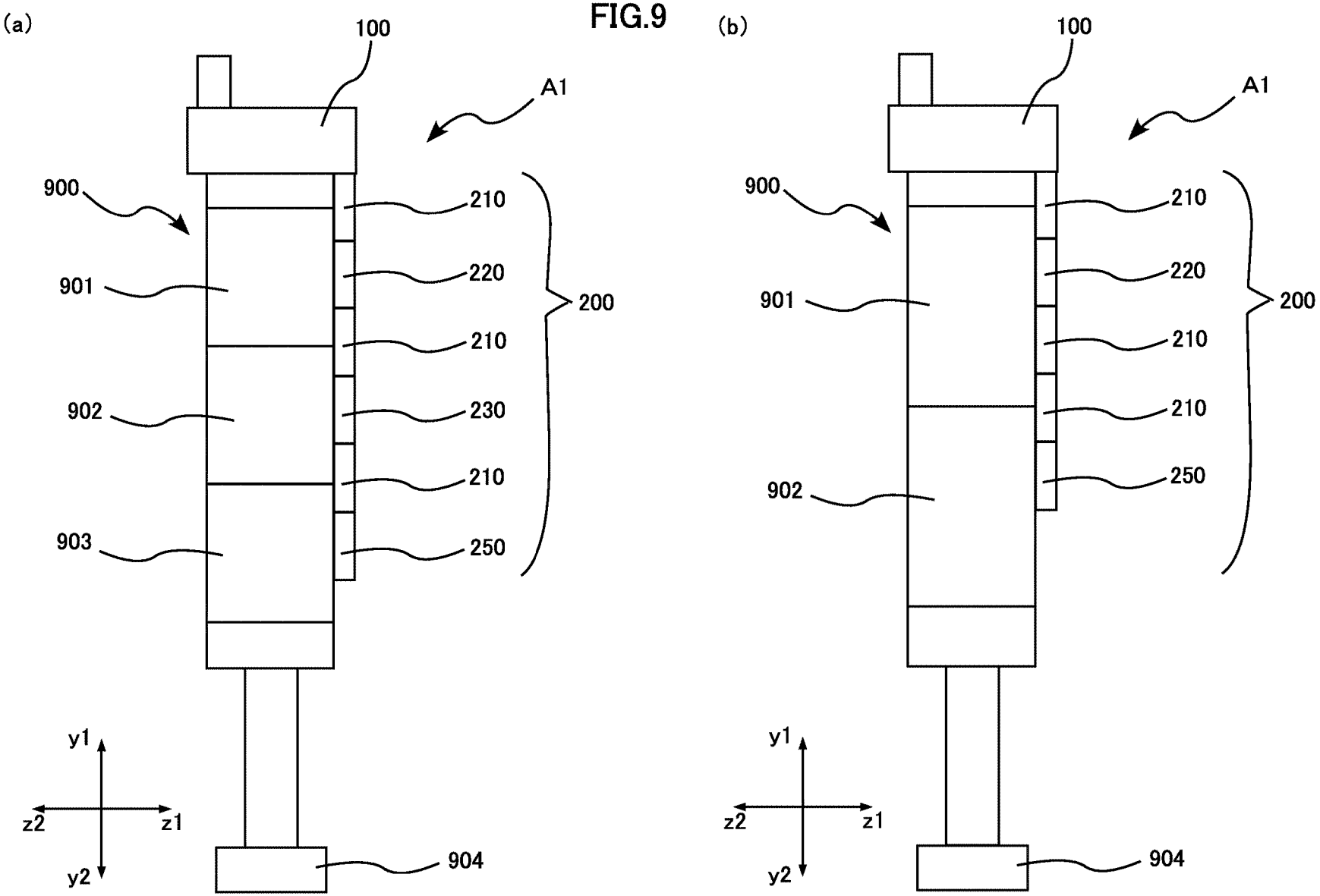
FIG. 9 is a schematic view showing a signaling lamp monitor as attached to other types of stack signaling lamps.

In the example shown in FIG. 9(*b*), the stack signaling lamp 900 has two light emitters 901 and 902. In this case, use may be made of two sensor blocks 220 and 250, which are connected by two relay blocks 210. A single relay block 210 is disposed also between (the connector 213 of) the uppermost sensor block 220 and (the connector 160 of) the main body 100.

Next, the signaling lamp monitor A1 is attached to the stack signaling lamp 900. Specifically, the main body 100 of the signaling lamp monitor A1 is placed on the top of the stack signaling lamp 900. The bottom surface of the main body 100 and the upper surface of the stack signaling lamp 900 are bonded together with a double-sided adhesive tape, for example.

Alternatively, the bottom surface of the main body 100 (the bottom surface of the case 102 shown in FIG. 2) may be formed with a recess conforming to the shape of the upper surface of the stack signaling lamp 900, and the recess may be fitted to the upper end of the stack signaling lamp 900. By placing the main body 100 on the top of the stack signaling lamp 900, the detection unit 200 extending vertically from the bottom surface of the main body 100 is arranged along the side surface of the stack signaling lamp 900.

The operation and advantages of the signaling lamp monitor A1 are described below.

The signaling lamp monitor A1 has the detection unit 200 that detects the light emitted from the stack signaling lamp 900. Based on the light detected by the detection unit 200, the signaling lamp monitor A1 identifies the light emission state (on, flashing, or off) or the light emission color and generates a detection signal based on the identification result. The signaling lamp monitor A1 transmits the detection signal by wireless communication. The signaling lamp monitor A1 can be easily attached to the stack signaling lamp 900 just by placing the main body 100 on a part (the top in the illustrated example) of the stack signaling lamp 900. The signaling lamp monitor A1 detects the light emitted from the stack signaling lamp 900 to the outside (i.e., the light indicating the operating state of a production apparatus). Thus, it is not necessary to provide a wiring for transmitting signals between the signaling lamp monitor A1 and the stack signaling lamp 900 (or the production apparatus). Moreover, the provision of the solar battery 122 and the capacitor for power supply eliminates the need for providing a power line to supply electric power from outside. Thus, the signaling lamp monitor A1 can be easily attached to the stack signaling lamp 900 in a short time. Moreover, since the signaling lamp monitor can be attached to a conventional stack signaling lamp 900, it can be introduced at a low cost as compared with purchasing a new stack signaling lamp incorporating a communication circuit.

As described above, the wireless module 120 is provided with the solar battery 122. Further, the wireless module 120 performs communication conforming to the EnOcean communication standard. This communication standard adopts a battery-less wireless transmission technology and allows wireless communication with small power. Thus, the signaling lamp monitor A1 can perform wireless communication without using a dry cell, for example. This eliminates the trouble of replacing batteries.

The wireless module 120 is provided with a capacitor for charging the electric power generated by the solar battery 122. Thus, even when the solar battery 122 cannot generate power, the electric power charged in the capacitor can be supplied. Also, the main body 100 has an auxiliary battery mounted to the battery holder 150. Thus, even when neither power generation by the solar battery 122 nor power supply from the capacitor is possible, electric power can be supplied from the auxiliary battery.

The detection signal generated by the controller 330 is transmitted to the outside by the transmitter 340. At this time, the power supply 310 supplies electric power to the transmitter 340 only when the detection signal is being transmitted. This reduces power consumption. Also, the controller 330 generates detection signals at relatively long time intervals when the light emission state does not change.

This also reduces power consumption. On the other hand, when the light emission state changes, the controller 330 immediately generates a detection signal. Thus, it is possible to quickly inform the management apparatus 800 of the change of the state.

The detection unit 200 is made by assembling a necessary number of sensor blocks and relay blocks. Thus, in accordance with the dimensions of the stack signaling lamp 900, for example, a suitable detection unit 200 can be provided easily.

The main body 100 is placed on the top of the stack signaling lamp 900, for example. The antenna 123 is disposed on the main body 100 such that the central axis extends vertically. The antenna 123 may emit electromagnetic waves uniformly around the central axis. Thus, the electromagnetic waves emitted from the antenna 123 can reach a wide range. Of course, the orientation of the antenna 123 may be varied appropriately, and the present disclosure is not limited to this example.

As shown in FIGS. 2 and 3, the light-receiving surface 122*a* of the solar battery 122 faces vertically upward. With such an arrangement, the solar battery 122 easily receives light from above. Of course, the orientation of the light-receiving surface 122*a* may be varied appropriately, and the present disclosure is not limited to this example.

As shown in FIG. 6, a variable resistor 140 is connected to each of the photodiodes 225. Thus, the sensitivity of each photodiode can be individually adjusted by adjusting the resistance of the relevant variable resistor 140. Moreover, as shown in FIG. 2, each variable resistor 140 is arranged such that the surface formed with the adjustment groove 141 faces in the horizontal direction (e.g. the x2 direction). Thus, even when the main body 100 is on the top of the stack signaling lamp 900, adjustment of the resistance value is easy. As shown in FIG. 3, in the present embodiment, the variable resistors 140 are arranged at locations that do not overlap with the wireless module 120 as viewed in plan. Since the surface formed with the adjustment groove 141 faces in the horizontal direction, adjustment of the resistance is easy even when the variable resistors 140 are disposed between the circuit board 110 and the wireless module 120. Other components may be disposed at the positions of the variable resistors 140 shown in FIG. 3.

Unlike the present embodiment, the surface formed with the adjustment groove 141 of each variable resistor 140 may be oriented in other directions, such as in the y1 direction for example. In this case, the load by the work for adjusting the resistance acts perpendicular (or generally perpendicular) to the surface of the circuit board 110. This prevents the variable resistor 140 from becoming detached from the circuit board 110 during such resistance adjustment work.

The switch 130 is arranged such that the push button 131 extends in the horizontal direction (e.g. in the x2 direction). Thus, pressing the push button 131 is easy even when the main body 100 is on the top of the stack signaling lamp 900. It is also possible to arrange the switch 130 between the circuit board 110 and the wireless module 120. Unlike the present embodiment, the push button 131 may be configured to extend vertically upward, for example.

The stack signaling lamp 900 shown in FIG. 1 is provided with three light emitters 901, 902 and 903. However, the present disclosure is not limited to this, and the number of the stack signaling lamps 900 may be varied appropriately. Since the illustrated signaling lamp monitor A1 has four sensor blocks 220, 230, 240 and 250, it is applicable to a stack signaling lamp 900 having at most four light emitters. As described above, in accordance with the number and dimensions of the light emitters, appropriate numbers of sensor blocks and relay blocks may be combined to provide the detection unit 200. For example, when the number of the light emitters is five, the relay blocks 210 and the sensor blocks 220 as well as the main body 100 may be configured so as to increase the number of the current paths shown in FIG. 6 (a single current path may be considered to be formed for a single photodiode) by one. The signaling lamp monitor A1 is also applicable to a monochromatic signaling light with a single light emitter configured to indicate the operating state based on the light emission state (on, flashing, or off) alone.

Although the module board 121 and the solar battery 122 are provided as an integral unit in the above wireless module 120, the present disclosure is not limited to this. The module board 121 and the solar battery 122 may be arranged as spaced apart from each other. Such an increased degree of freedom for the component arrangement contributes to the size reduction or thickness reduction of the housing 101.

FIGS. 10-29 show other embodiments. In these figures, the elements that are identical or similar to those of the foregoing first embodiment are denoted by the same reference signs as those used for the first embodiment.

Figure 10:
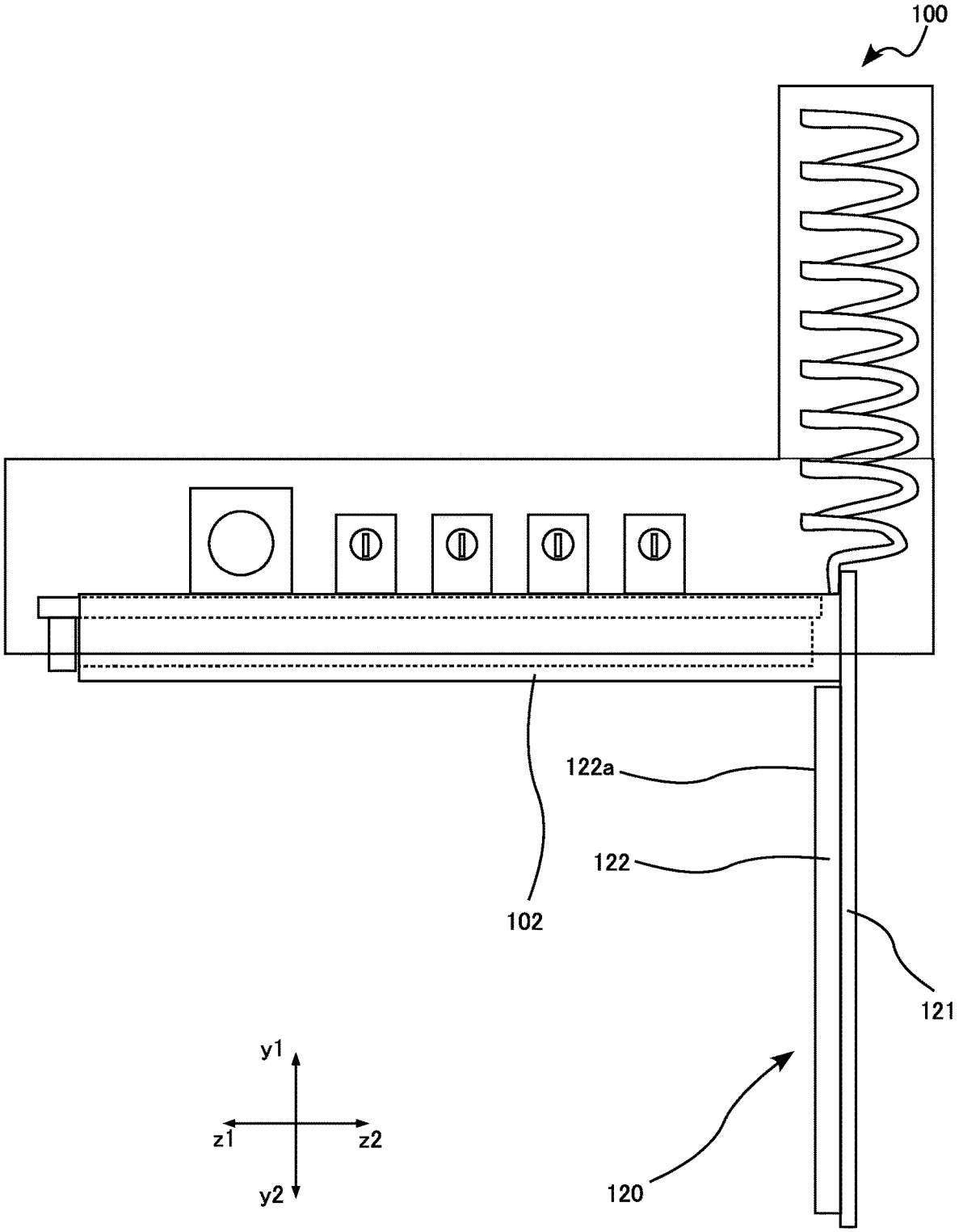
FIG. 10 is a front view showing a main body of a signaling lamp monitor according to a second embodiment.

FIG. 10 is a front view of the main body of a signaling lamp monitor according to a second embodiment. The signaling lamp monitor A2 shown in FIG. 10 differs from the signaling lamp monitor A1 (see FIG. 2) in arrangement position of the wireless module 120.

In the signaling lamp monitor A2, the wireless module 120 is fixed to a side surface of the case 102 such that the light-receiving surface 122*a* of the solar battery 122 faces in the horizontal direction (z1 direction). In this case, the solar battery 122 can receive the light emitted from the stack signaling lamp 900 to generate electric power.

Note that rather than changing the arrangement of the entire wireless module 120, the arrangement of the solar battery 122 alone may be changed. For example, the arrangement position of the wireless module 120 may remain the same as that in the signaling lamp monitor A1 according to the first embodiment, and the solar battery 122 alone may be arranged such that the light-receiving surface 122*a* faces in the z1 direction.

Figure 11:
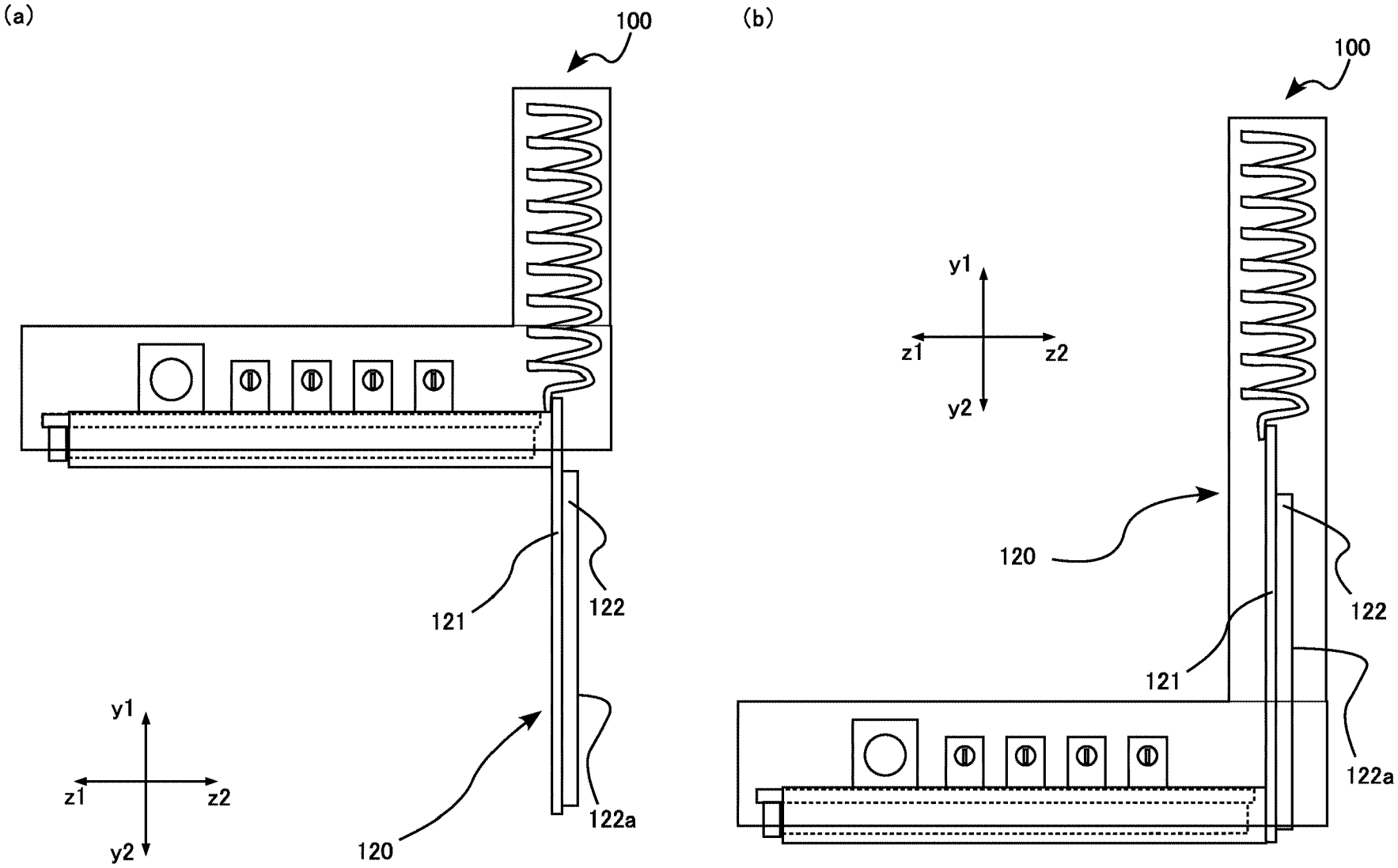
FIG. 11 is a front view showing a variation of the signaling lamp monitor.

As shown in FIG. 11(*a*), the light-receiving surface 122*a* of the solar battery 122 may be arranged to face in the z2 direction. Such an arrangement is advantageous for receiving the light from z2 direction when the stack signaling lamp 900 is arranged close to the ceiling of a room in a factory and little light comes from the y1 direction, for example. In this case again, rather than changing the arrangement of the entire wireless module 120, the arrangement of the solar battery 122 alone may be changed.

Further, as shown in FIG. 11(*b*), at least a part of the wireless module 120 may be located on the y1 side of the case 102. Also, a plurality of solar batteries 122 may be provided. For example, a solar battery 122 may be added to the signaling lamp monitor A1 according to the first embodiment, and the light-receiving surface 122*a* of the added solar battery 122 may be arranged to face the z1 direction.

Figure 12:
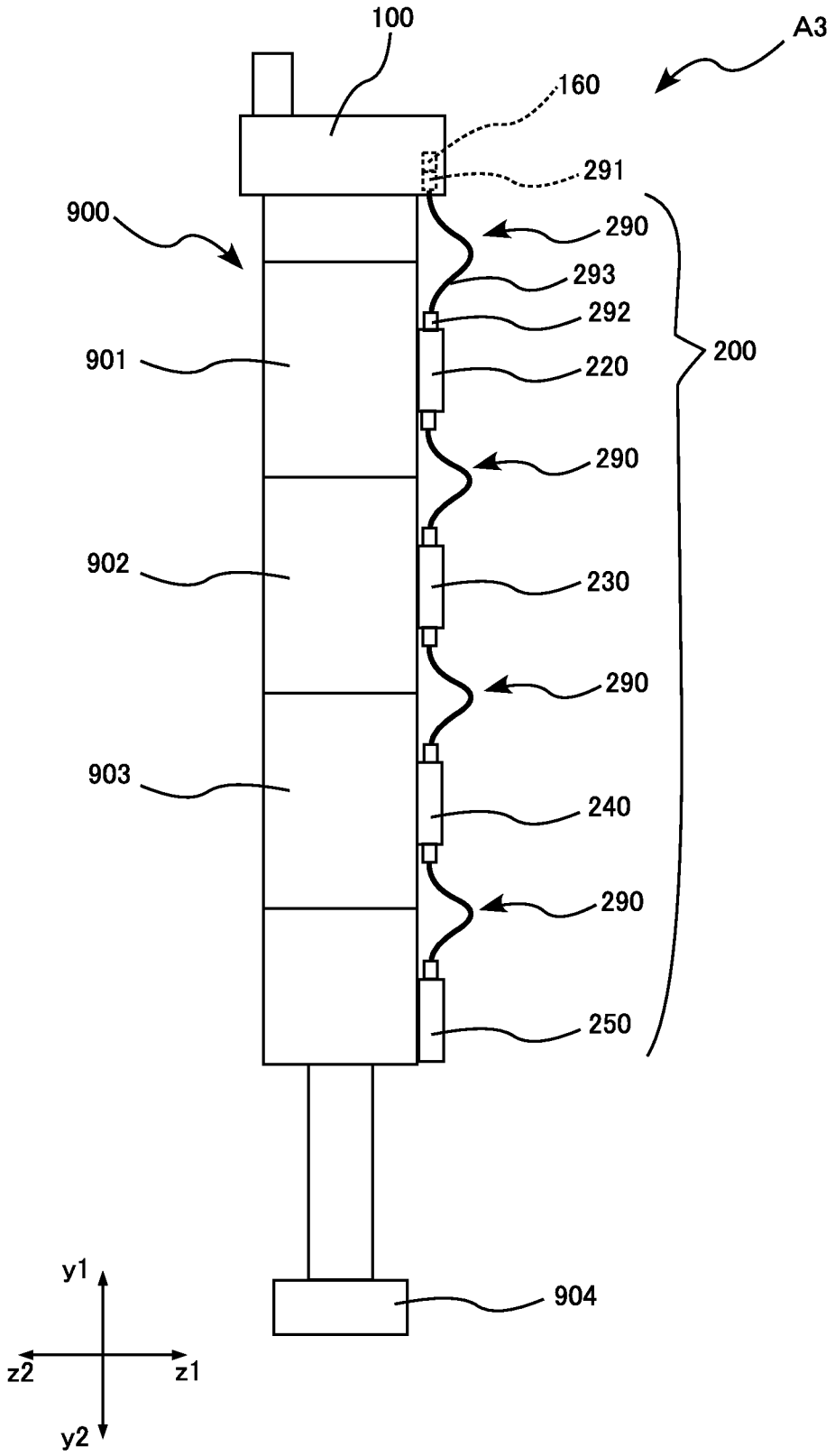
FIG. 12 is a schematic view showing a signaling lamp monitor according to a third embodiment as attached to a stack signaling lamp.

FIG. 12 is a schematic view showing the overall configuration of a signaling lamp monitor according to a third embodiment. The signaling lamp monitor A3 shown in FIG. 12 differs from the signaling lamp monitor A1 according to the first embodiment (see FIG. 1) in configuration of the detection unit 200.

In the detection unit 200 of the third embodiment, the sensor blocks 220, 230, 240, 250 and the main body 100 are not connected by relay blocks but connected by relay cables 290. Each relay cable 290 is provided by connecting a connector 291 and a connector 292, which are the same as the connector 213 and the connector 214 of the relay blocks 210 according to the first embodiment, with a flexible cable 293. The sensor blocks 220, 230 and 240 are fixed to the light emitters 901, 902 and 903, respectively, with a double-sided adhesive tape, for example. Instead of the relay cables 290, use may be made of a flexible connecting member such as a flexible substrate for connection.

In the present embodiment again, the detection unit 200 may be configured to adapt to the configuration of the stack signaling lamp 900. The distance between adjacent sensor blocks can be set freely within the range of the length of the relay cable 290.

Figure 13:
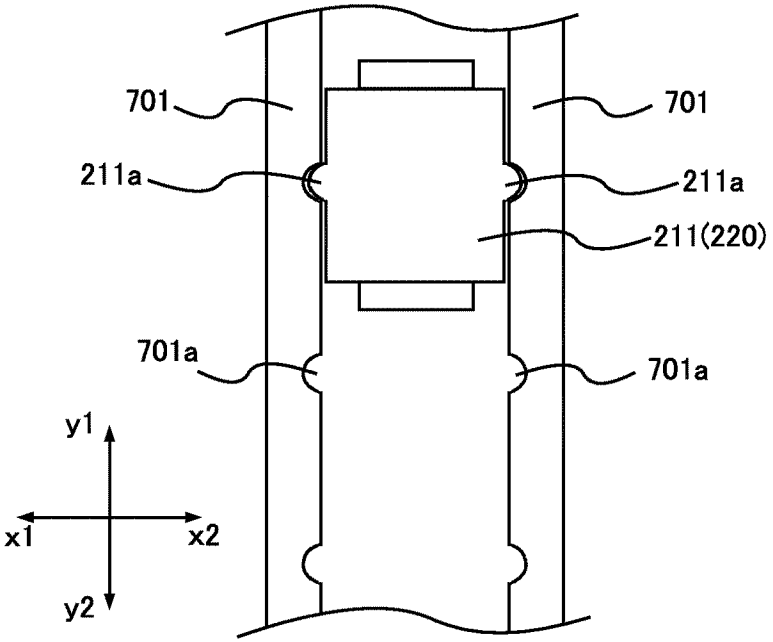
FIG. 13 illustrates variations of a method for fixing the sensor block of the signaling lamp monitor.
Figure 13:
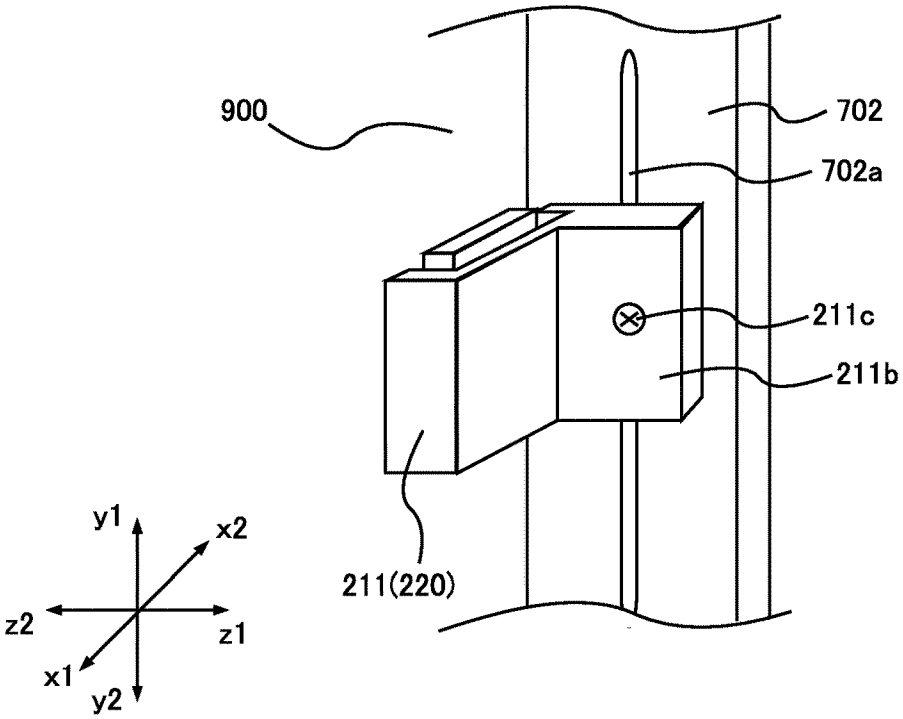

The means for fixing the sensor blocks to the light emitters is not limited to a double-sided adhesive tape. FIG. 13 shows variations of a method for fixing the sensor blocks.

FIG. 13(*a*) shows an example in which the sensor block 220 is fixed by two block supporters 701 extending in the y2 direction from the main body 100 (not shown). The two block supporters 701 are provided with mutually facing recesses 701*a* at predetermined intervals in the y direction. The case 211 of the sensor block 220 is provided with projections 211*a* projecting in the x1 direction and the x2 direction, respectively. The sensor block 220 is fixed between the two block supporters 701 by bringing the two projections 211*a* into engagement with the recesses 701*a* located at the relevant light emitter 901. Unlike this, the sensor block 220 may be configured to be slidable in the y direction along the two block supporters 701.

FIG. 13(*b*) shows an example in which the sensor block 220 is fixed by a single block supporter 702 extending in the y2 direction. The surface of the block supporter 702 that faces in the x1 direction is formed with a groove 702*a* extending in the y direction. The case 211 of the sensor block 220 is provided with a fixing part 211*b* extending in the z1 direction. By fixing the fixing part 211*b* to the groove 702*a* with a screw 211*c*, the sensor block 220 can be fixed to a predetermined position (e.g. the position corresponding to the light emitter 901) of the block supporter 702. Note that an element other than the screw 211*c* may be used for fixation.

Figure 14:
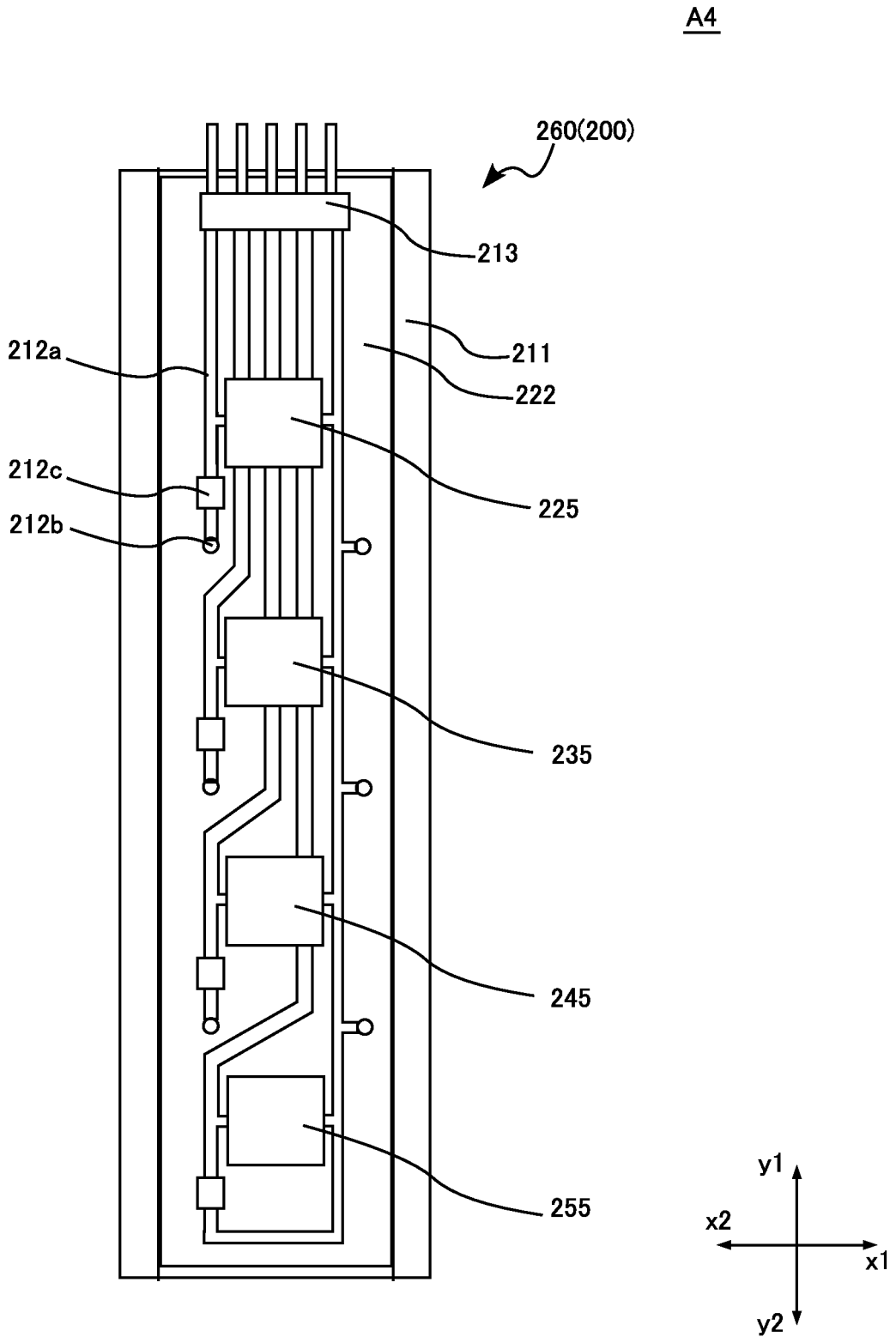
FIG. 14 is a front view showing the detection unit of the signaling lamp monitor.

FIG. 14 is a front view of the detection unit 200 of a signaling lamp monitor according to a fourth embodiment. The signaling lamp monitor A4 shown in FIG. 14 differs from the signaling lamp monitor A1 of the first embodiment (see FIG. 4) in configuration of the detection unit 200.

The detection unit 200 of the fourth embodiment is constituted of a single detection block 260 provided with a plurality of photodiodes (four photodiodes 225, 235, 245 and 255 in the illustrated example). The detection block 260 corresponds to the configuration obtained by extending the case 211 and the sensor board 222 of the sensor block 220 according to the first embodiment in the y direction and mounting four photodiodes 225, 235, 245 and 255 in a row at predetermined intervals on the sensor board 222. That is, in the present embodiment, a plurality of photodiodes are mounted on a single common sensor board. The detection block 260 is connected to the main body 100 by connecting the connector 213 to the connector 160 of the main body 100.

In the present embodiment, assembling the detection unit 200 as in the first embodiment is not necessary, and it is only necessary to connect the detection block 260 to the connector 160 of the main body 100. Thus, the signaling lamp monitor can be constructed and attached to the stack signaling lamp 900 in a shorter time.

Figure 15:
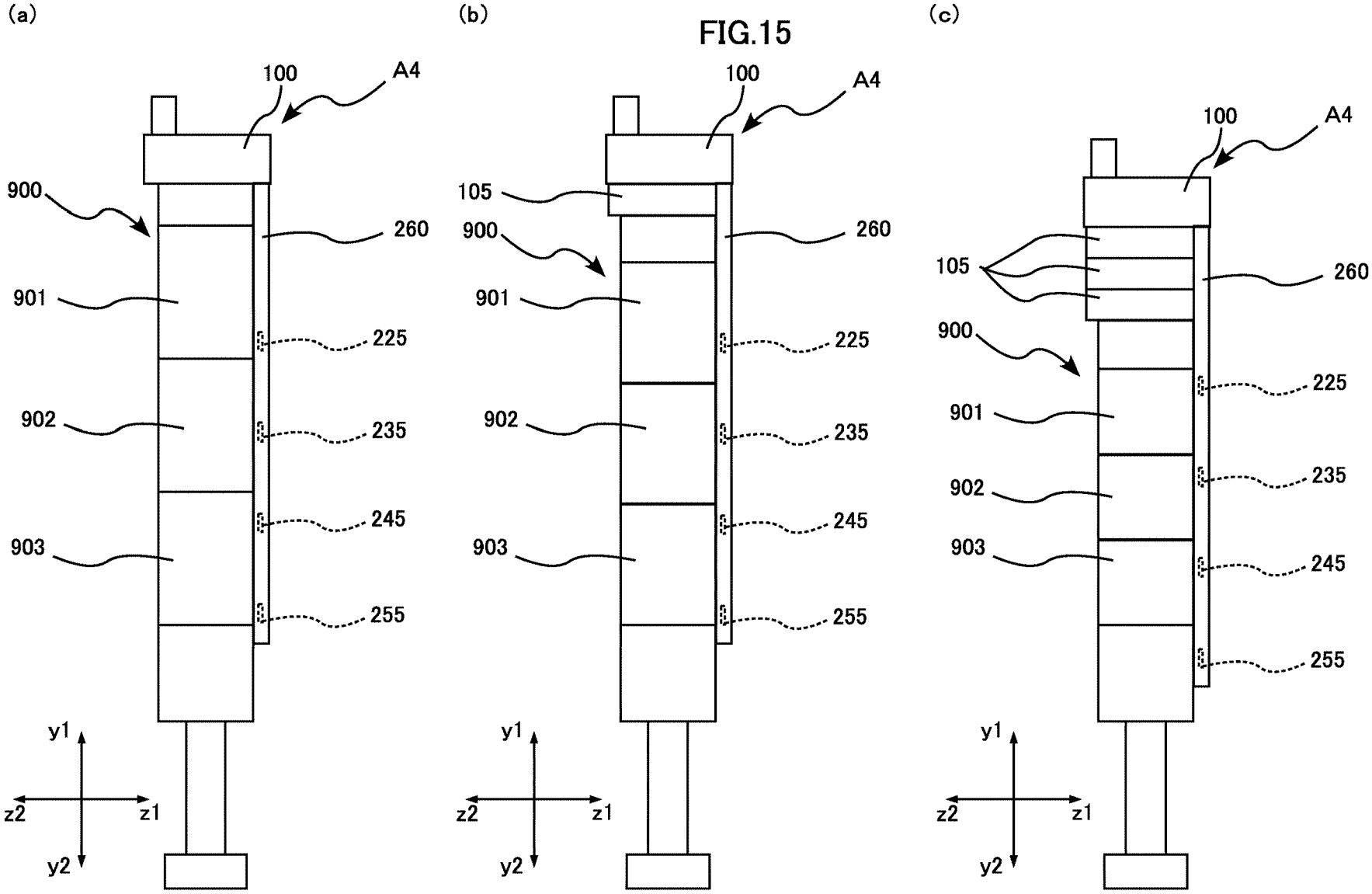
FIG. 15 is a schematic view showing mounting examples of the signaling lamp monitor.

In the fourth embodiment, as shown in FIGS. 15(*b*) and (*c*), a necessary number of spacers 105 are prepared and disposed between the top surface of the stack signaling lamp 900 and the bottom surface of the main body 100 of the signaling lamp monitor A4. This allows the photodiodes 225, 235 and 245 to be arranged at proper positions to receive the light emitted from the light emitters 901, 902 and 903, respectively. Note that, as shown in FIG. 15(*a*), the spacer 105 may not be used in some cases.

Figure 16:
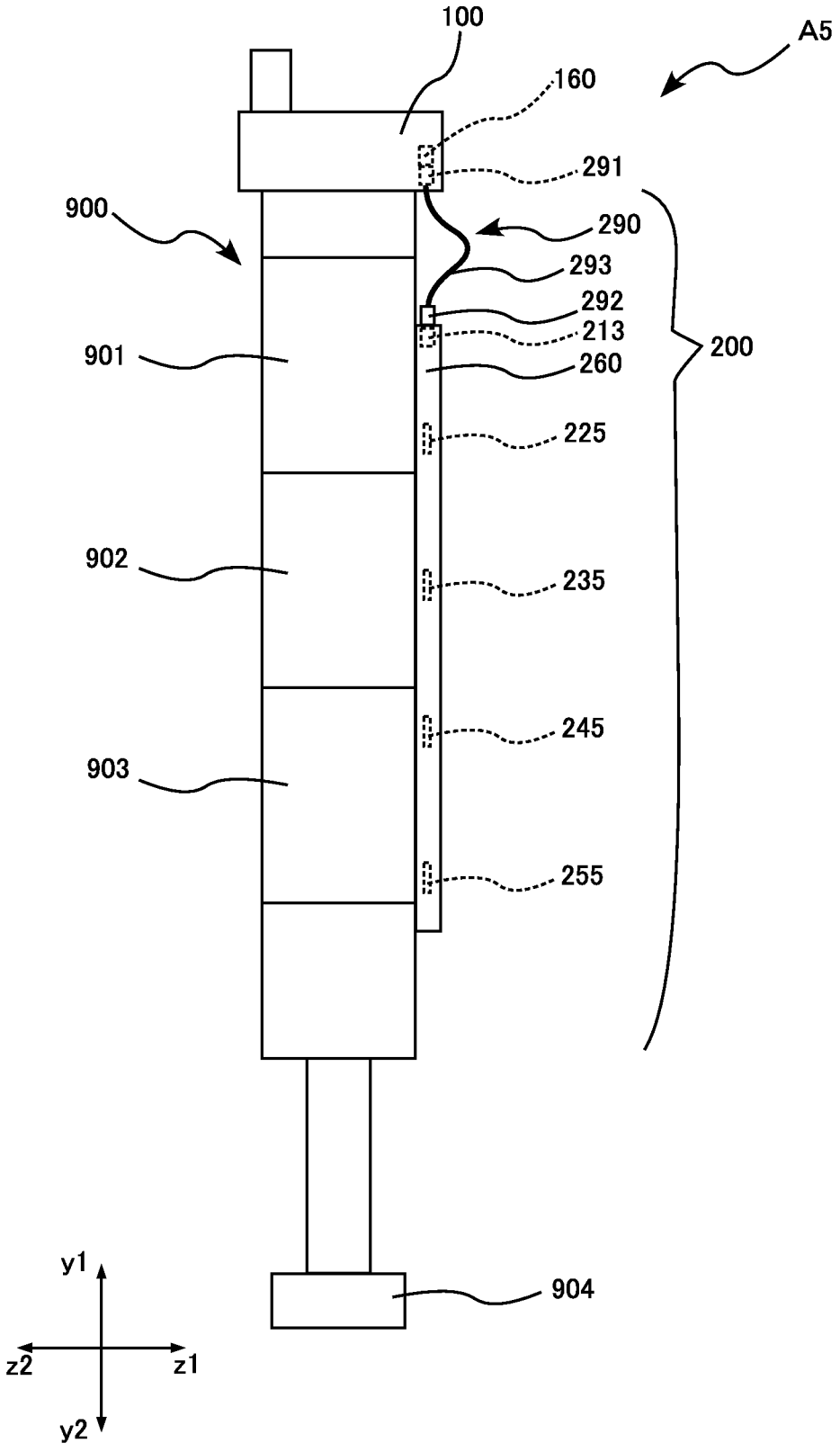
FIG. 16 is a schematic view showing a signaling lamp monitor according to a fifth embodiment as attached to a stack signaling lamp.

FIG. 16 is a schematic view showing the overall configuration of a signaling lamp monitor according to a fifth embodiment. The signaling lamp monitor A5 shown in FIG. 16 differs from the signaling lamp monitor A1 of the first embodiment (see FIG. 1) in configuration of the detection unit 200.

The detection unit 200 of the fifth embodiment may correspond to the detection block 260 of the fourth embodiment to which the relay cable 290 of the third embodiment is added. In the detection unit 200, the connector 213 of the detection block 260 and the connector 292 of the relay cable 290 are connected to each other, and the detection unit is connected to the main body 100 by connecting the connector 291 of the relay cable 290 to the connector 160 of the main body 100. The detection block 260 is fixed to a position where the photodiodes 225, 235 and 245 can receive the light emitted from the light emitters 901, 902 and 903, respectively, with a double-sided adhesive tape, for example, though the present disclosure is not limited to this. Instead of the relay cable 290, use may be made of a flexible connecting member such as a flexible board for connection.

In the present embodiment, the detection block 260 may be displaced in the y direction within the range of the length of the relay cable 290. Thus, as compared with the fourth embodiment, the signaling lamp monitor is applicable to a wider range of stack signaling lamps 900.

Figure 17:
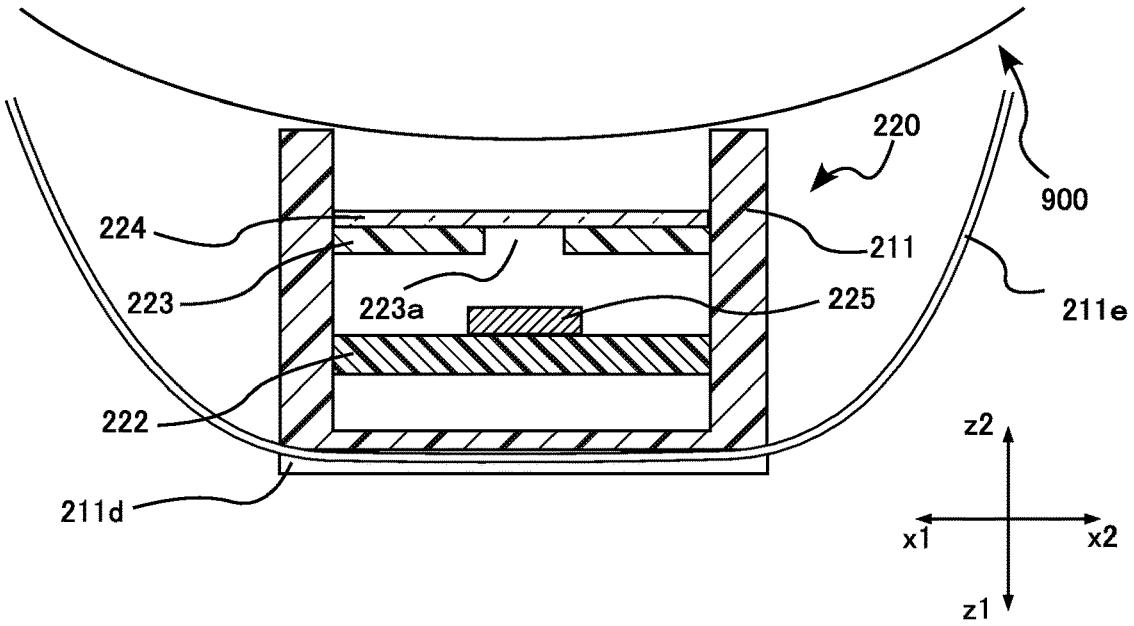
FIG. 17 shows variations of a block according to the first through fifth embodiments, where (a) is a sectional view, and (b) is an explanatory view.
Figure 17:
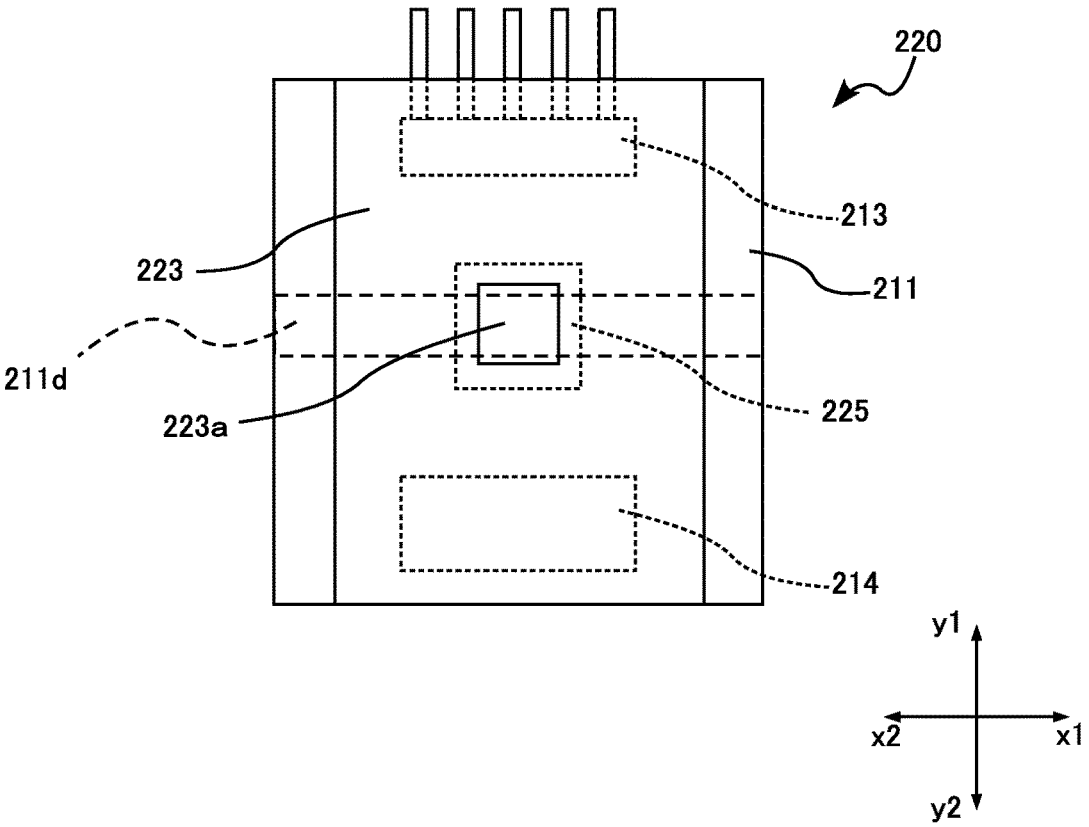

FIG. 17 is a view for explaining a variation of each sensor block 220 according to the first to fifth embodiments described above. Specifically, FIG. 17(*a*) is a sectional view of the sensor block 220 according to the variation as attached to the stack signaling lamp 900. FIG. 17(*b*) is an explanatory view of the sensor block 220 according to the variation.

In the sensor block 220 according to this variation, the two walls of the case 211 that are spaced apart from each other in the x direction are extended in the z2 direction as compared with the example shown in FIG. 4, for example. Between these two walls are disposed a lid 223 and a transparent plate 224. The lid 223 and the transparent plate 224 are arranged on the outer side with respect to the sensor board 222, or on the z2 side of the sensor board 222. The lid 223 is a rectangular plate made of the same material as that for the case 211, for example, and formed with a window 223*a* as an opening. With the lid arranged in the case 211, the window 223*a* is located in front of the photodiode 225. The transparent plate 224 may be a rectangular plate that transmits light and arranged on the z2 side of the lid 223. Alternatively, the transparent plate 224 may be arranged on the z1 side of the lid 223. The transparent plate 224 may be made of a transparent synthetic resin or glass, though the present disclosure is not limited to this. The sensor block 220 is fixed such that the front ends of the two walls are brought into contact with the side surface of the stack signaling lamp 900 (see FIG. 17(*a*)).

The length of the above-described two walls (the length as seen in the cross section shown in FIG. 17(*a*)) is set such that the side surface of the stack signaling lamp 900 will not come into contact with the transparent plate 224 (or the lid 223) when the front end of each wall is brought into contact with the side surface of the stack signaling lamp 900. By appropriately setting the wall length (e.g. by making it sufficiently long), even in use for various stack signaling lamps 900 having different diameters, the side surface of the stack signaling lamp 900 is prevented from coming into contact with the transparent plate 224 (or the lid 223) while also the formation of a gap between the side surface of the stack signaling lamp 900 and the front ends of the two walls is prevented.

The light emitted from the stack signaling lamp 900 passes through the window 223*a* and is received by the photodiode 225. Meanwhile, other unnecessary light may be blocked by the case 211 and the lid 223. Thus, the photodiode 225 is prevented from receiving the light as noise. Also, by closing the case with the transparent plate 224, dust is prevented from entering the case 211 through the window 223*a*. Of course, the present disclosure is not limited to this, and only one of the lid 223 and the transparent plate 224 may be disposed. The transparent plate 224 may be made smaller than that in the illustrated example and may have a size just to cover the window 223*a* of the lid 223. Alternatively, the transparent plate 224 may be colored so as not to transmit light except the portion coinciding with the window 223*a*. In this case, the transparent plate 224 (that is partially transparent) may function also as the lid, so that the lid 223 may not necessarily be provided. Moreover, a flexible light-shielding material may be provided at portions of the case 211 that come into contact with the stack signaling lamp 900, which is advantageous for reducing intrusion of external light.

In the sensor block 220 according to this variation, the outer surface (the surface facing in the z1 direction) of the bottom of the case 211 is formed with a groove 211*d* extending in the x direction. In the example shown in FIG. 17(*b*), the groove 211*d* is arranged at the center of the outer surface of the bottom in the y direction, though the present disclosure is not limited to this. The groove 211*d* is used for fixing the sensor block 220 to the stack signaling lamp 900 using a fixing band 211*e*. That is, by disposing a part of the fixing band 211*e* in the groove 211*d*, the fixing band 211*e* is prevented from moving relative to the sensor block 220, which realizes stable fixation between the sensor block 220 and the stack signaling lamp 900.

Figure 18:
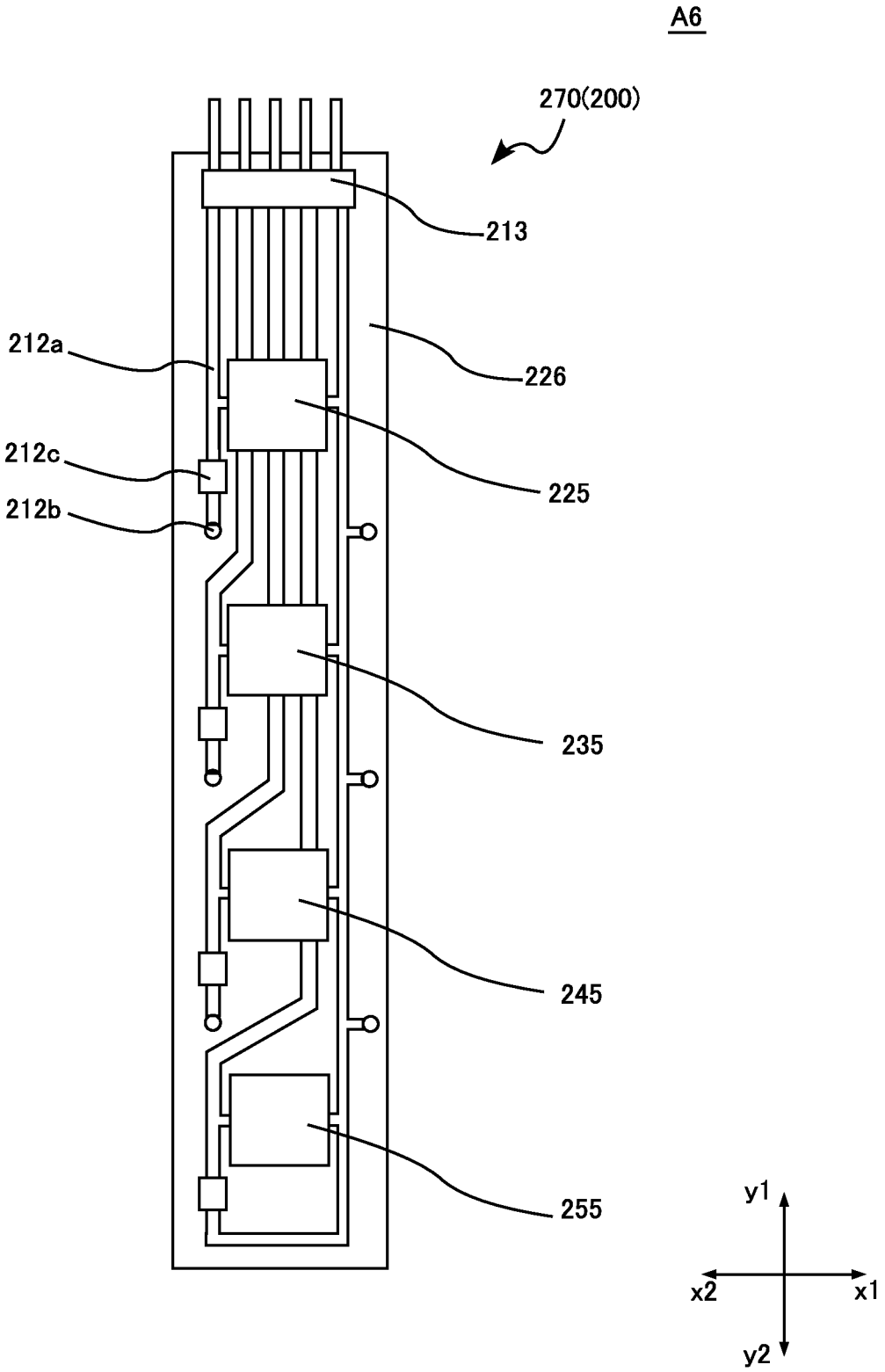
FIG. 18 is a front view showing a detection unit of a signaling lamp monitor according to a sixth embodiment.
Figure 19:
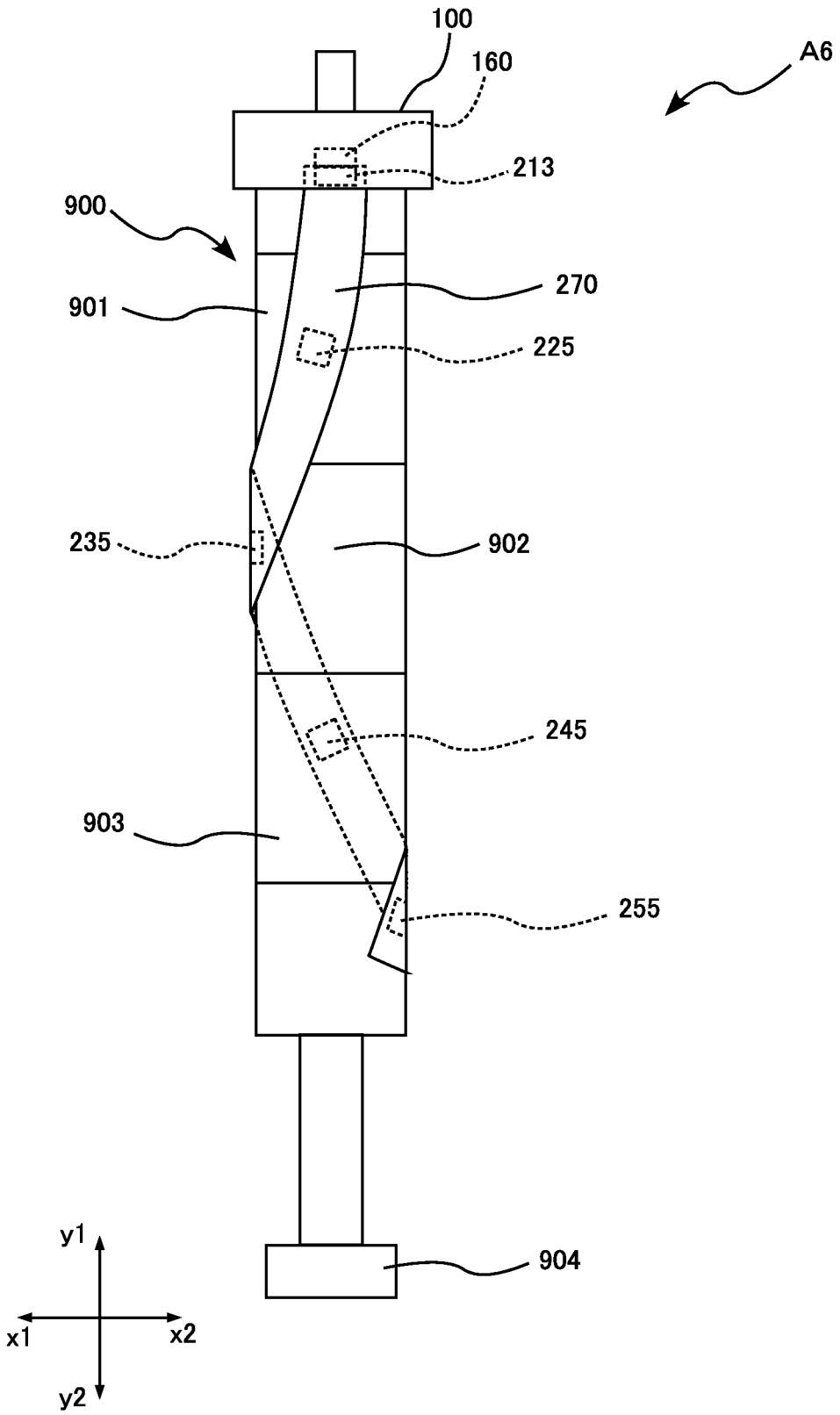
FIG. 19 is a schematic view showing a signaling lamp monitor according to a sixth embodiment as attached to a stack signaling lamp.

FIGS. 18 and 19 show a signaling lamp monitor according to a sixth embodiment. FIG. 18 is a front view of the detection unit 200. FIG. 19 is a schematic view showing the overall configuration and shows the state as seen from the z1 side. The signaling lamp monitor A6 shown in FIGS. 18 and 19 differs from the signaling lamp monitor A1 according to the first embodiment (see FIGS. 1 and 4) in configuration of the detection unit 200.

The detection unit 200 of the sixth embodiment is constituted of a single detection board 270. The detection board 270 corresponds to the detection block 260 according to the fourth embodiment in which a flexible printed board 226 is employed as the sensor board 222 and the case 211 is omitted. That is, the detection board 270 is constituted of a flexible printed board 226 elongated in the y direction on which four photodiodes 225, 235, 245 and 255 are mounted in a row at predetermined intervals and a connector 213 is mounted at the end on the y1 side. The detection board 270 is connected to the main body 100 by connecting the connector 213 to the connector 160 of the main body 100. The detection board 270 is spirally wound around the stack signaling lamp 900 such that the photodiodes 225, 235 and 245 can receive the light emitted from the light emitters 901, 902 and 903, respectively, and fixed to the lamp with a double-sided adhesive tape, for example. The method for fixing the detection board 270 to the stack signaling lamp 900 is not limited. In order not to block the light emitted from the stack signaling lamp 900, it is preferable that the flexible printed board 226 is transparent.

In the present embodiment, changing the manner of winding the detection board 270 allows for application to various types of stack signaling lamp 900. For example, the angle of winding (i.e., the angle formed by the detection board 270 and the y direction) may be increased when the dimension of each light emitter 901, 902 and 903 in the y direction is shorter and may be reduced when the dimension is longer. Moreover, in the present embodiment, assembling the detection unit 200 as in the first embodiment is not necessary, and it is only necessary to connect the detection board 270 to the connector 160 and winding and fixing the detection board 270 around the stack signaling lamp 900. Thus, the signaling lamp monitor can be easily attached to the stack signaling lamp 900 in a shorter time.

Figure 20:
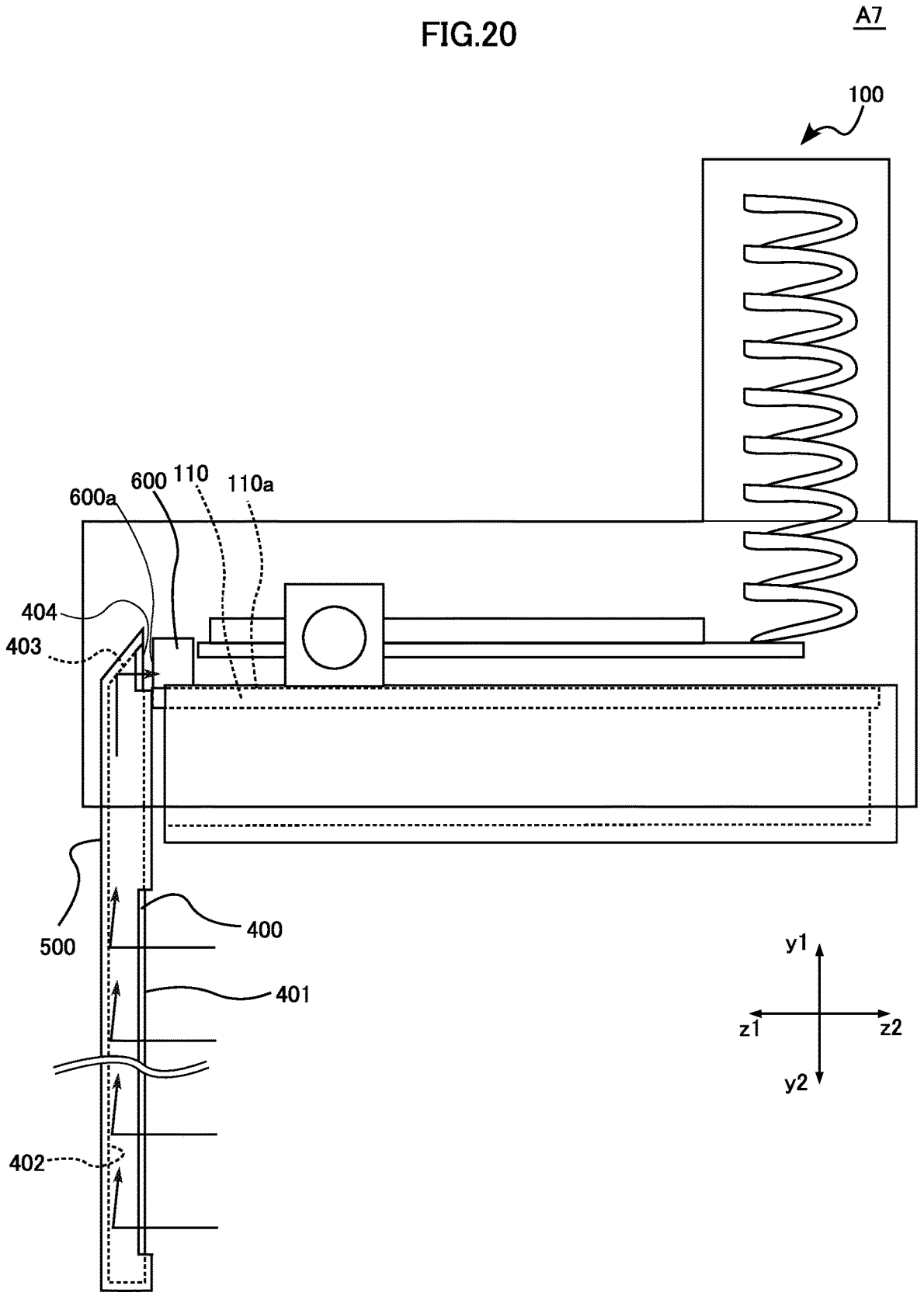
FIG. 20 is a front view showing a main body of a signaling lamp monitor according to a seventh embodiment.

FIG. 20 is a front view of the main body 100 of a signaling lamp monitor according to a seventh embodiment. The signaling lamp monitor A7 shown in the figure differs from the signaling lamp monitor A1 according to the first embodiment (see FIG. 2) in that the light emitted by the stack signaling lamp 900 is guided to the main body 100.

The signaling lamp monitor A7 according to the seventh embodiment includes a light guide 400, a light guide case 500 and a color sensor 600 instead of the detection unit 200 according to the first embodiment. The color sensor 600 is disposed at the end in the z1 direction of the front surface 110*a* of the circuit board 110 such that a light-receiving surface 600*a* faces in the z1 direction. The light guide case 500 housing the light guide 400 is fixed to the end in the z1 direction of the circuit board 110 such that its longitudinal axis is along the y direction.

The light guide 400 guides the light emitted by the stack signaling lamp 900 to the main body 100. The light guide 400 has a thin elongate shape extending in the y direction as a whole and is generally circular in cross section in the present embodiment. The light guide 400 is made of a transparent material which may be an acrylic resin such as poly methyl methacrylate rein (PMMA resin for short). The light guide 400 has a light incident surface (light detection surface) 401, reflective surfaces 402 and 403, and a light emission surface 404. The light incident surface 401 is a surface on which the light emitted by the stack signaling lamp 900 becomes incident. The light incident surface 401 is elongated in the y direction and continues from below the bottom surface of the main body 100 almost to the end in the y2 direction of the light guide 400. The light incident surface 401 faces in the z2 direction so that it faces the side surface of the stack signaling lamp 900 (light emitters 901, 902 and 903) when the main body 100 is placed on the top of the stack signaling lamp 900. The reflective surface 402 is a surface that reflects the light entering through the light incident surface 401 in the y1 direction. The reflective surface 402 is in the same area in the y direction as that of the light incident surface 401 and opposite to the light incident surface 401. The reflective surface 403 is a surface that reflects the light traveling in the y1 direction in the z2 direction. The reflective surface 403 is the end surface of the light guide 400 in the y1 direction and inclined by 45 degrees with respect to the y direction. The light emission surface 404 is a surface through which the light reflected by the reflective surface 403 is emitted. The light emission surface 404 faces the light-receiving surface 600*a* of the color sensor 600.

The light entering through the light incident surface 401 is reflected by the reflective surface 402 to travel in the y1 direction, is then reflected by the reflective surface 403 to travel in the z2 direction, and is then emitted through the light emission surface 404. The light emitted through the light emission surface 404 becomes incident on the light-receiving surface 600*a* of the color sensor 600, or received by the color sensor 600. Since the light incident surface 401 is formed to spread over all the light emitters 901, 902 and 903 when the signaling lamp monitor A7 is attached to the stack signaling lamp 900, the light emitted from any of the light emitters 901, 902 and 903 becomes incident on the light incident surface. Thus, the light emitted from any of the light emitters 901, 902, 903 or mixed light from these becomes incident on the light-receiving surface 600*a* of the color sensor 600 as well.

The light guide case 500 holds the light guide 400 and prevents the leaking of light from the light guide 400 or the entering of external light. The light guide case 500 houses the light guide 400 while exposing the light incident surface 401 and the light emission surface 404 of the light guide 400 and is made of a white resin, for example.

The color sensor 600 outputs information on the light received by the light-receiving surface 600*a* to the controller 330. Based on the information inputted, the controller 330 identifies from which of the light emitters 901, 902 and 903 the incident light is emitted. Also, the controller 330 identifies the light emission state based on the information inputted.

Figure 21:
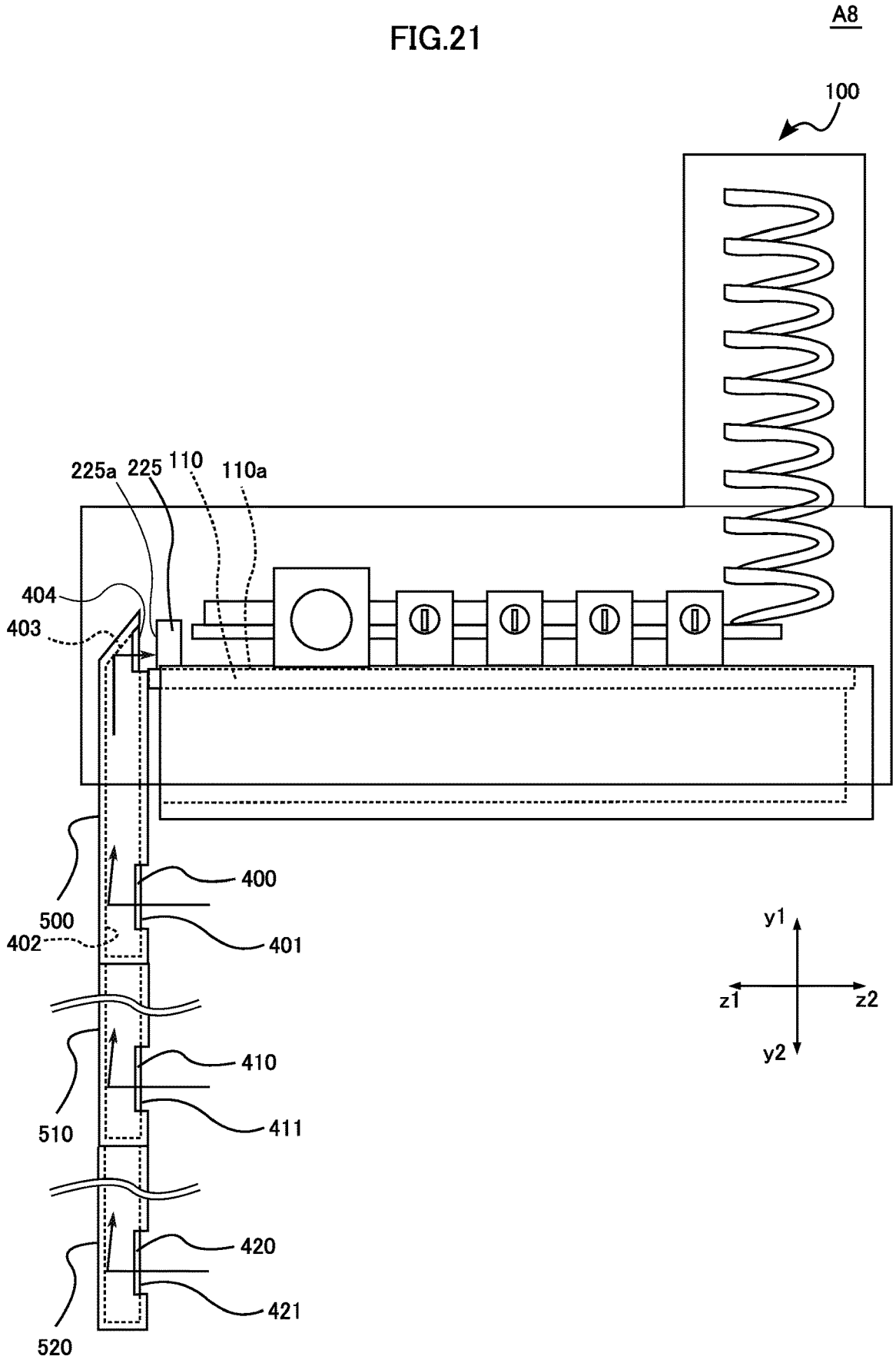
FIG. 21 is a front view of showing a main body of a signaling lamp monitor according to an eighth embodiment.
Figure 22:
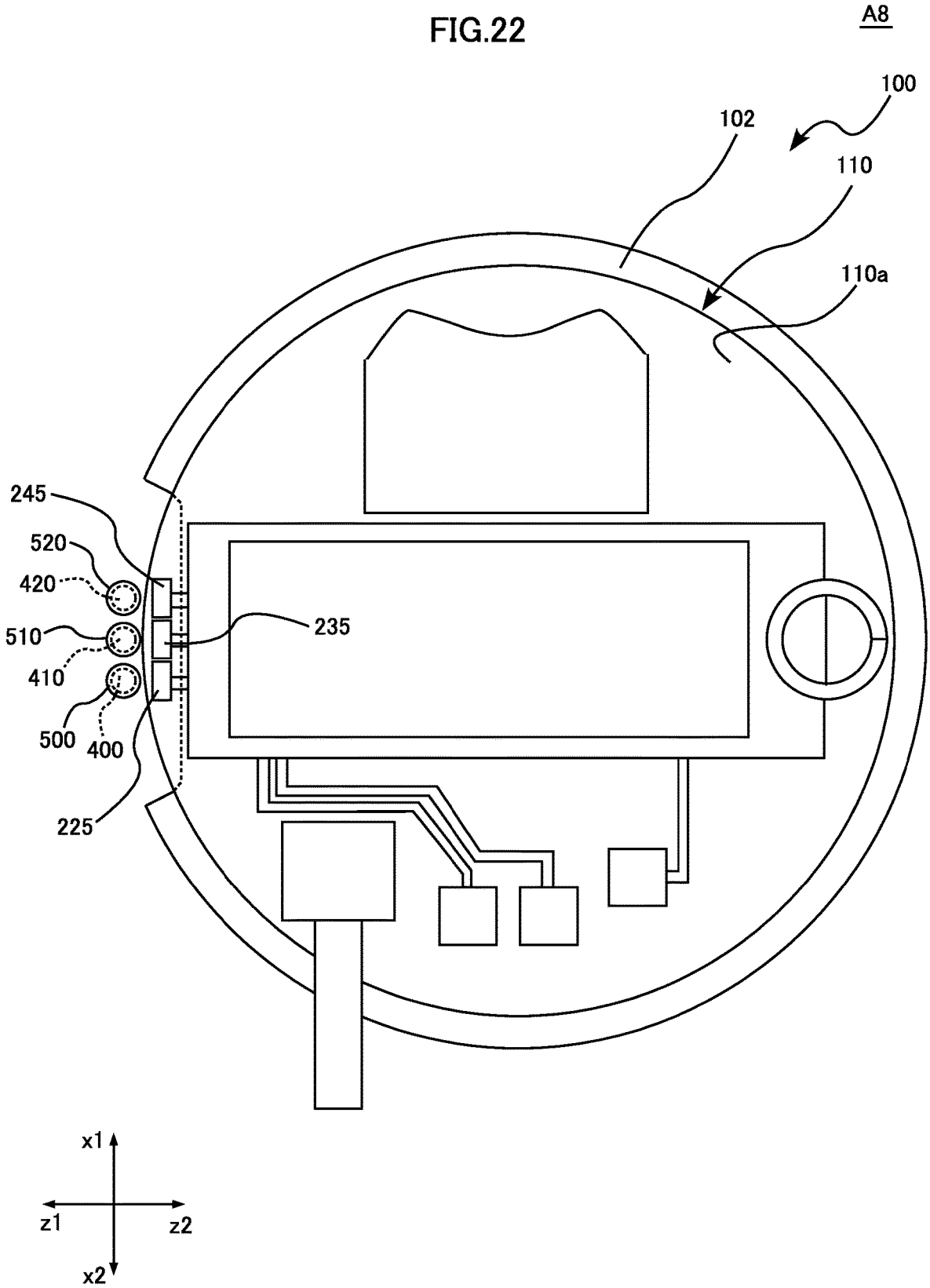
FIG. 22 is a plan view showing the main body of the signaling lamp monitor according to an eighth embodiment.

FIGS. 21 and 22 show a signaling lamp monitor according to an eighth embodiment. FIG. 21 is a front view of the main body 100. FIG. 22 is a plan view of the main body 100. The signaling lamp monitor A8 shown in FIGS. 21 and 22 differs from the signaling lamp monitor A1 according to the first embodiment (see FIGS. 2 and 3) in that the light emitted by the stack signaling lamp 900 is guided to the main body 100.

As with the seventh embodiment, the signaling lamp monitor A8 according to the eighth embodiment guides the light emitted by the stack signaling lamp 900 to the main body 100 using a light guide. However, rather than guiding the light emitted from the light emitters 901, 902, and 903 by using a single light guide, the signaling lamp monitor A8 has three light guides that individually guide the light emitted from each of the light emitters 901, 902 and 903. Specifically, the signaling lamp monitor A8 has light guides 400, 410 and 420, light guide cases 500, 510 and 520, and photodiodes 225, 235 and 245. The photodiodes 225, 235 and 245 are mounted at the end in the z1 direction of the front surface 110*a* of the circuit board 110 such that the light-receiving surfaces 225*a*, 235*a* and 245*a* face in the z1 direction. The photodiodes 225, 235 and 245 are aligned in the mentioned order from the x2 side toward the x1 side. The light guide case 500 housing the light guide 400, the light guide case 510 housing the light guide 410, and the light guide case 520 housing the light guide 420 are arranged such that their longitudinal axes are along the y direction and fixed to the end in the z1 direction of the circuit board 110 as aligned in the mentioned order from the x2 side toward the x1 side.

The light guide 400 and the light guide case 500 are similar to the light guide 400 and the light guide case 500 of the seventh embodiment, but have shorter dimensions in the y direction and are provided only at the location where the light incident surface 401 faces the light emitter 901. Thus, the light guide 400 guides only the light emitted by the light emitter 901 to the main body 100. The light guide 410 and the light guide case 510 are also similar to the light guide 400 and the light guide case 500 of the seventh embodiment, but are provided only at the location where the light incident surface 411 faces the light emitter 902. Thus, the light guide 410 guides only the light emitted by the light emitter 902 to the main body 100. The light guide 420 and the light guide case 520 are also similar to the light guide 400 and the light guide case 500 of the seventh embodiment, but are provided only at the location where the light incident surface 421 faces the light emitter 903. Thus, the light guide 420 guides only the light emitted by the light emitter 903 to the main body 100.

The photodiodes 225, 235 and 245 are similar to the photodiodes 225, 235 and 245 of the first embodiment and receive the light guided by the light guides 400, 410 and 420, respectively. Thus, the photodiode 225 receives the light emitted by the light emitter 901, the photodiode 235 receives the light emitted by the light emitter 902, and the photodiode 245 receives the light emitted by the light emitter 903. As with the first embodiment, the controller 330 identifies the light emission state (on, flashing, or off) or the light emission color based on the current flowing through the photodiodes 225, 235 and 245.

Figure 23:
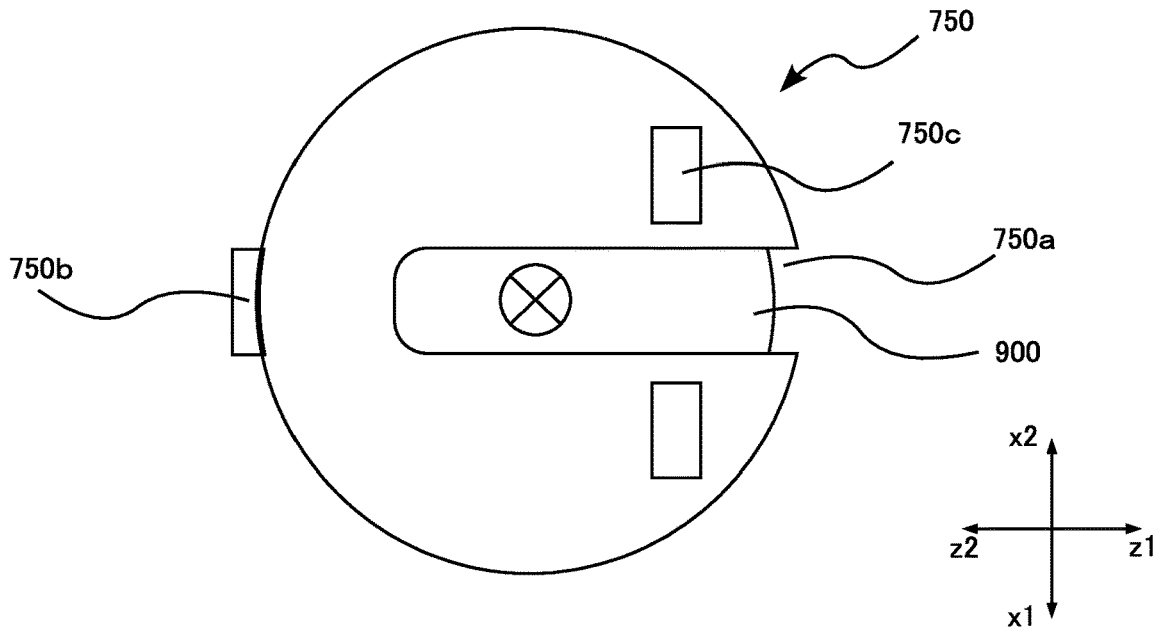
FIG. 23 is a plan view (a) and a front view (b) showing a main body fixture.
Figure 23:
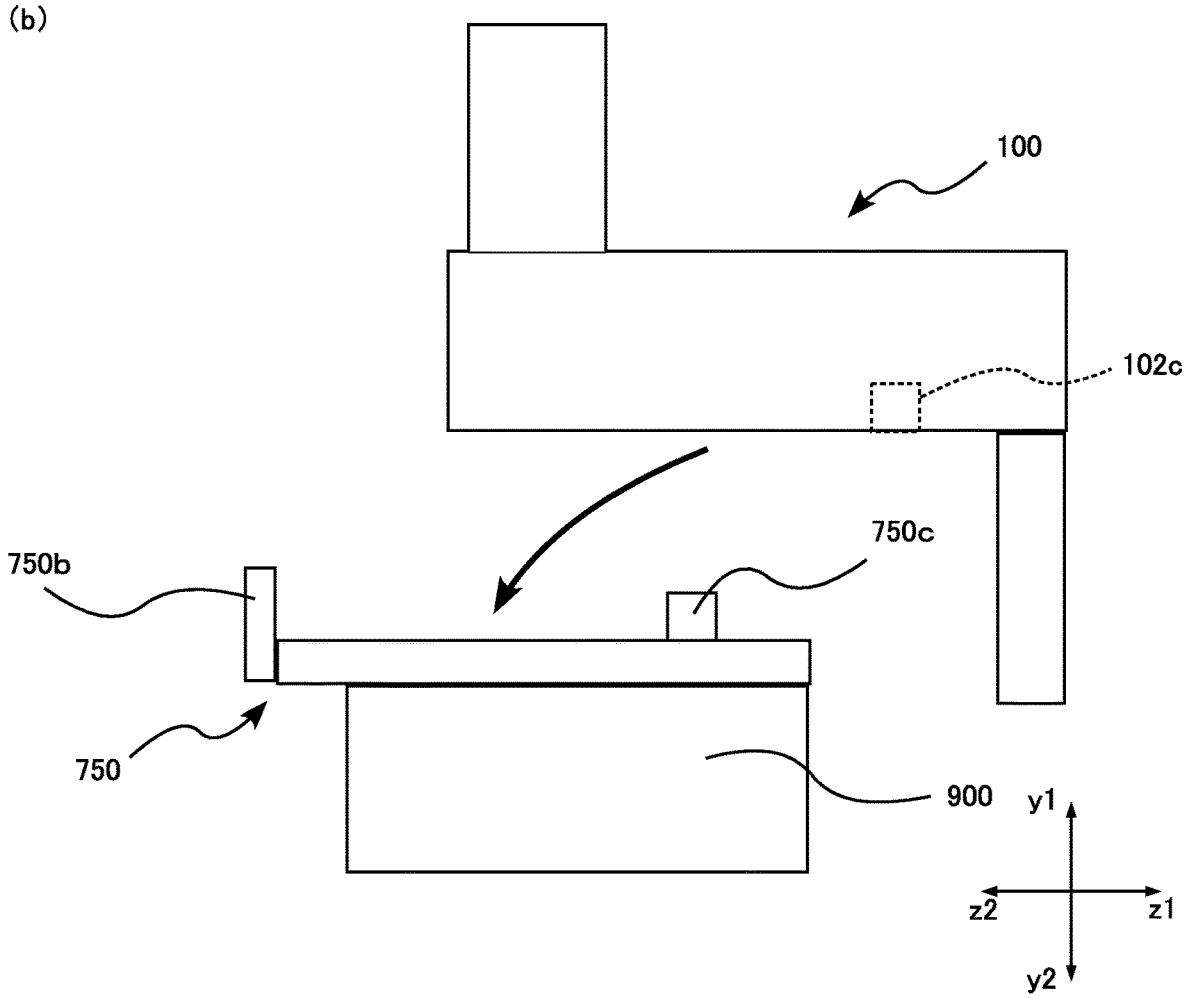

Although the first through the eighth embodiments describe the example in which the main body 100 is placed directly on the top of the stack signaling lamp 900, the present disclosure is not limited to this. A fixture for fixing the main body 100 may be placed on the top of the stack signaling lamp 900, and the main body 100 may be attached to the fixture. FIG. 23 is a view for explaining a main body fixture 750 as an example of such a fixture. FIG. 23(*a*) is a plan view of the main body fixture 750 as attached to the stack signaling lamp 900. FIG. 23(*b*) is a front view of the main body fixture 750 as attached to the stack signaling lamp 900.

The main body fixture 750 is a circular plate that may be made of a synthetic resin. The main body fixture 750 includes a cutout 750*a* extending longitudinally in the z2 direction from the end in the z1 direction, an engagement part 750*b* extending in the y1 direction from the end in the z2 direction, and two projections 750*c* arranged across the cutout 750*a* at locations offset in the z1 direction on the surface facing in the y1 direction. Note that the material and shape of the main body fixture 750 may vary. The main body fixture 750 is fixed to the top of the stack signaling lamp 900 with a double-sided adhesive tape, for example. At this time, the main body fixture 750 is fixed to the stack signaling lamp 900 such that a screw for disassembling the stack signaling lamp 900 is positioned in the cutout 750*a* (see FIG. 23(*a*)). Then, with the end of the main body 100 in the z2 direction brought into contact with the engagement part 750*b*, the projections 750*c* are fitted into holes 102*c* formed in the bottom surface of the main body 100 (case 102), whereby the main body 100 is fixed to the main body fixture 750 (see FIG. 23(*b*)).

The use of the main body fixture 750 facilitates attachment and detachment of the main body 100 to the stack signaling lamp 900. When the main body 100 is removed from the main body fixture 750, the screw for disassembling the stack signaling lamp 900 is in the cutout 750*a* of the main body fixture 750. Thus, by removing the screw, the stack signaling lamp 900 can be disassembled for maintenance. Thus, maintenance of the stack signaling lamp 900 can be easily performed even after the main body 100 is attached to the stack signaling lamp 900. Moreover, since the main body fixture 750 is configured to expose the head of a screw by the cutout 750*a*, it is applicable to stack signaling lamps 900 of various diameters.

Figure 24:
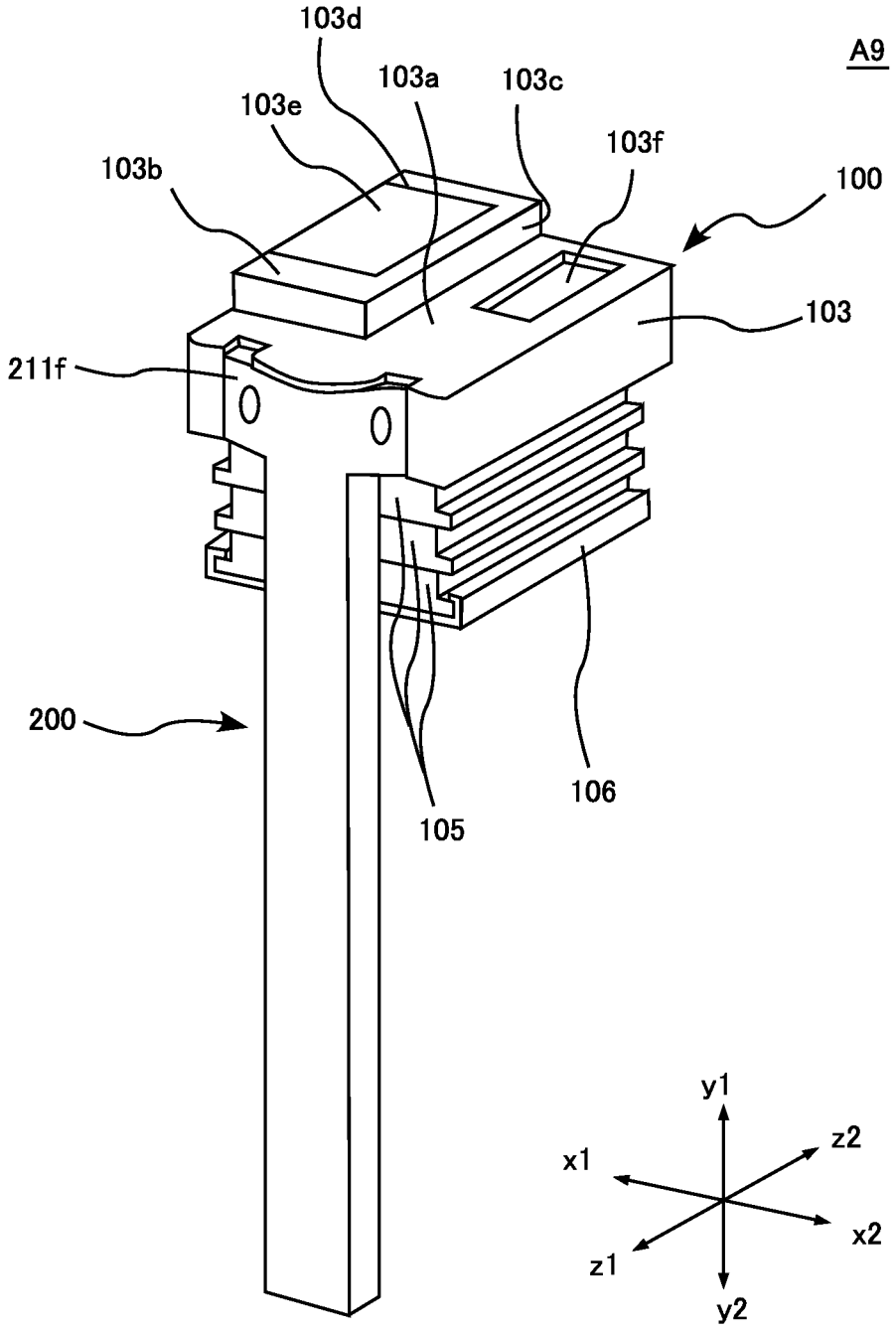
FIG. 24 is a perspective view showing the overall configuration of a signaling lamp monitor according to a ninth embodiment.
Figure 25:
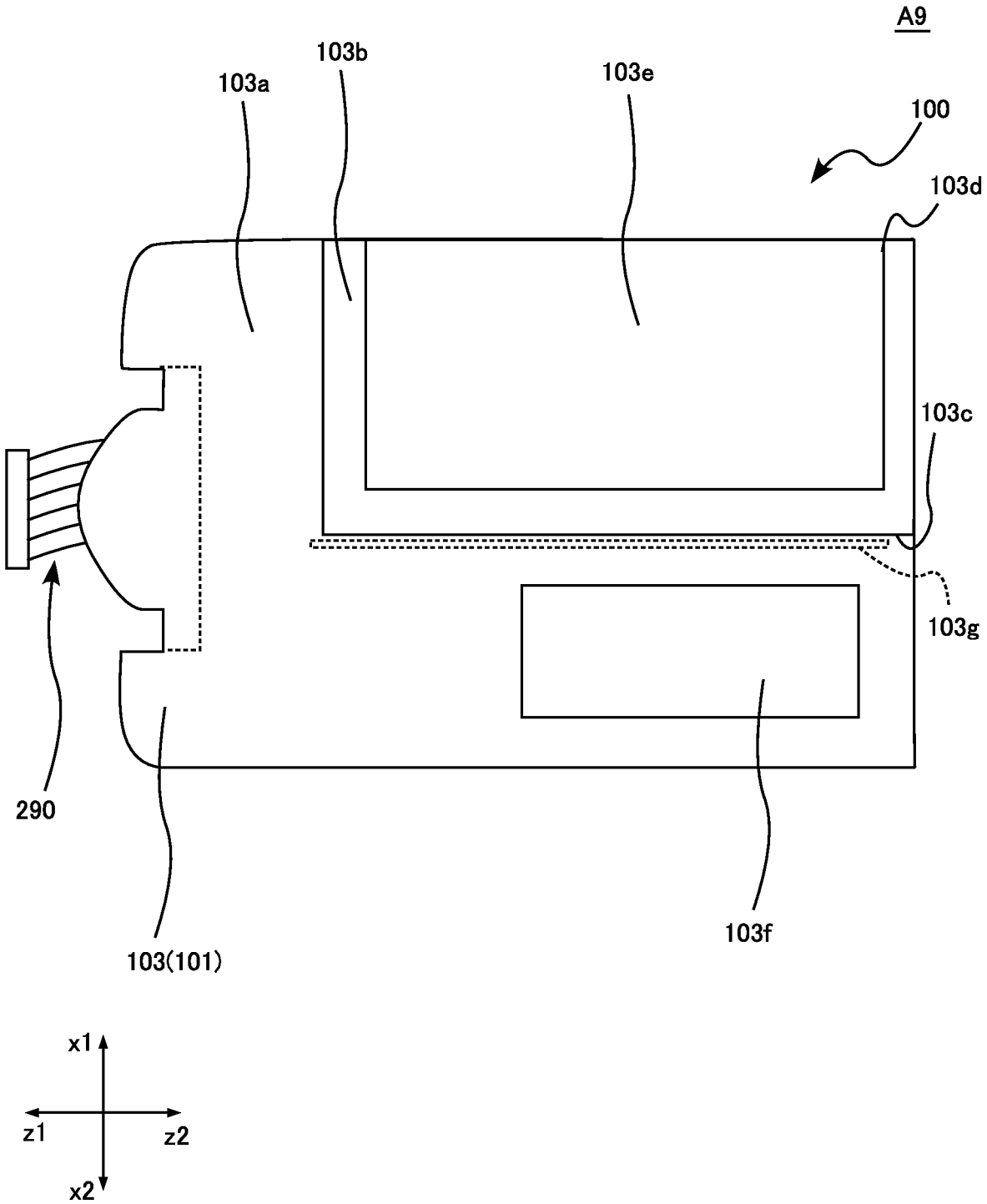
FIG. 25 is a plan view of the main body of the signaling lamp monitor shown in FIG. 24.
Figure 26:
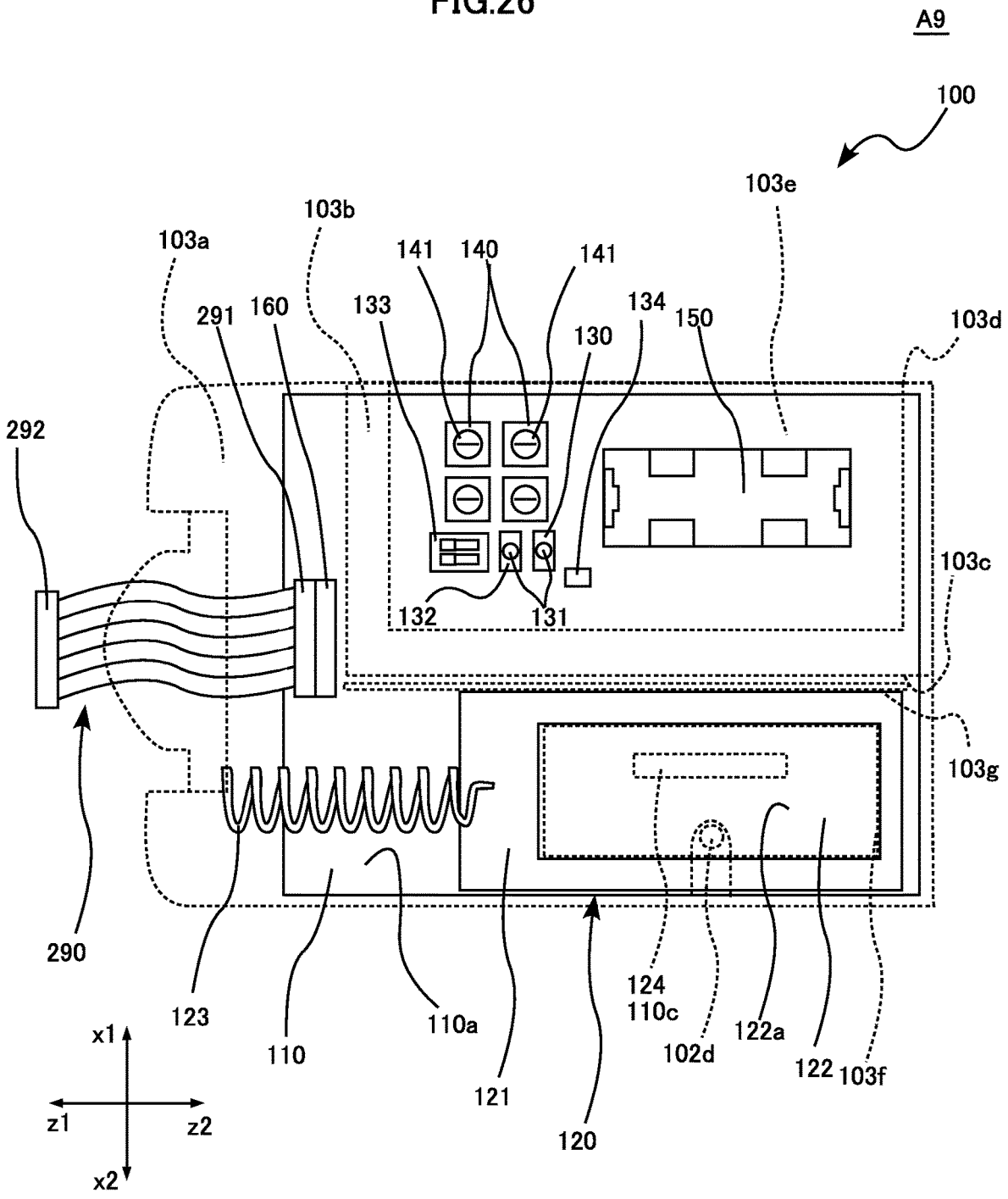
FIG. 26 is a plan view of the main body of the signaling lamp monitor shown in FIG. 24, illustrating the state seen through the case.
Figure 27:
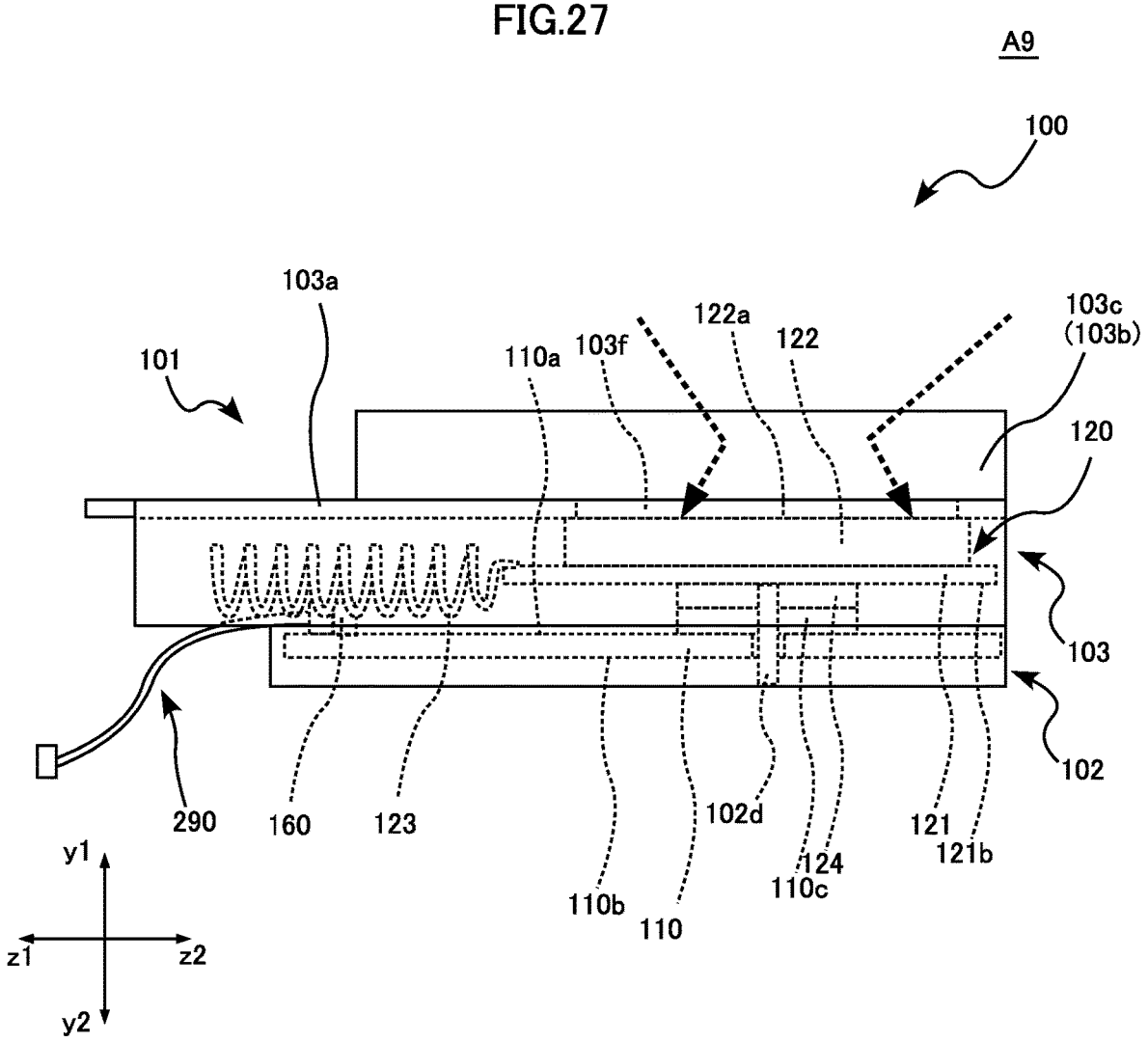
FIG. 27 is a front view of the main body of the signaling lamp monitor shown in FIG. 24.
Figure 28:
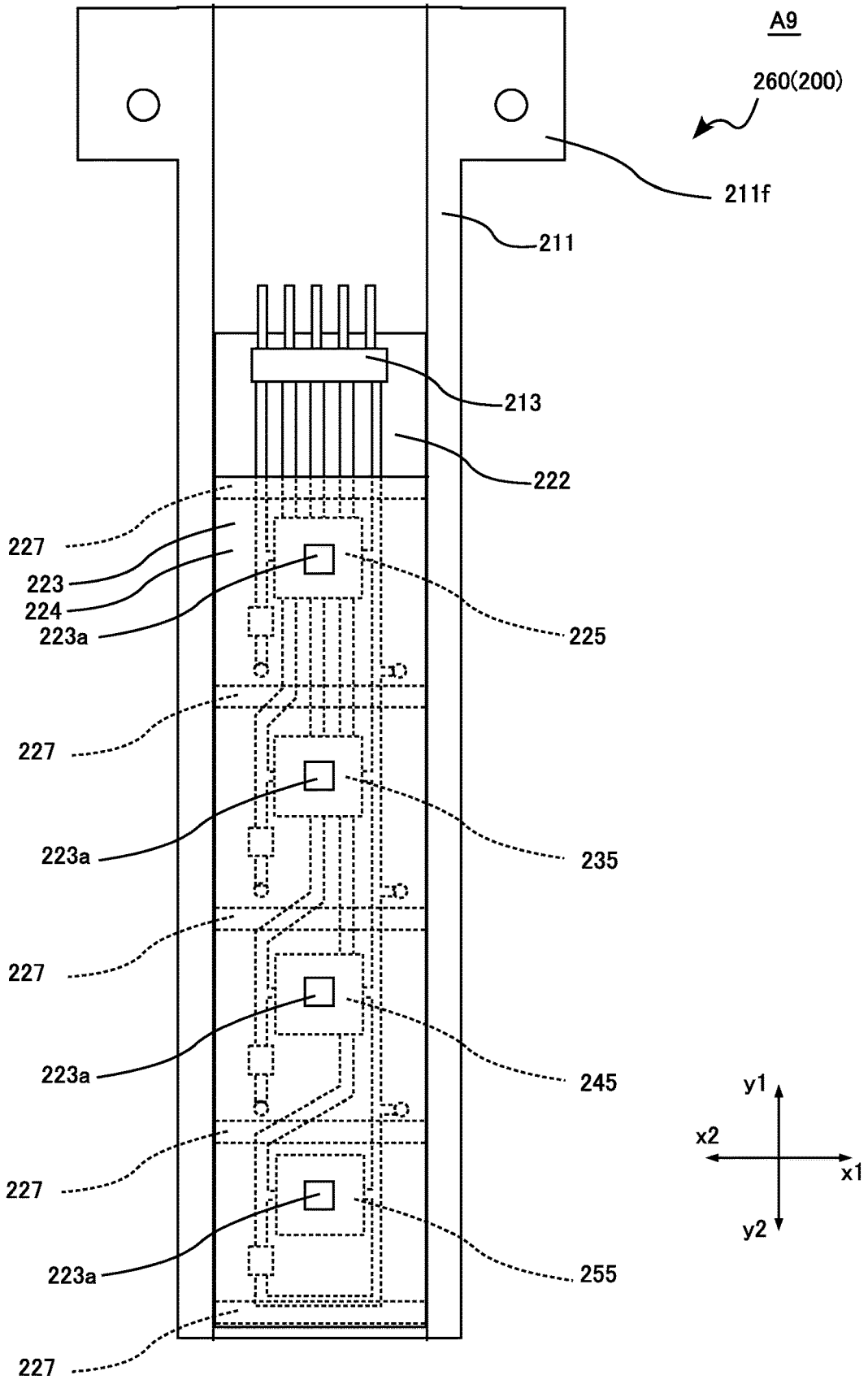
FIG. 28 is a front view of the detection unit of the signaling lamp monitor shown in FIG. 24.
Figure 29:
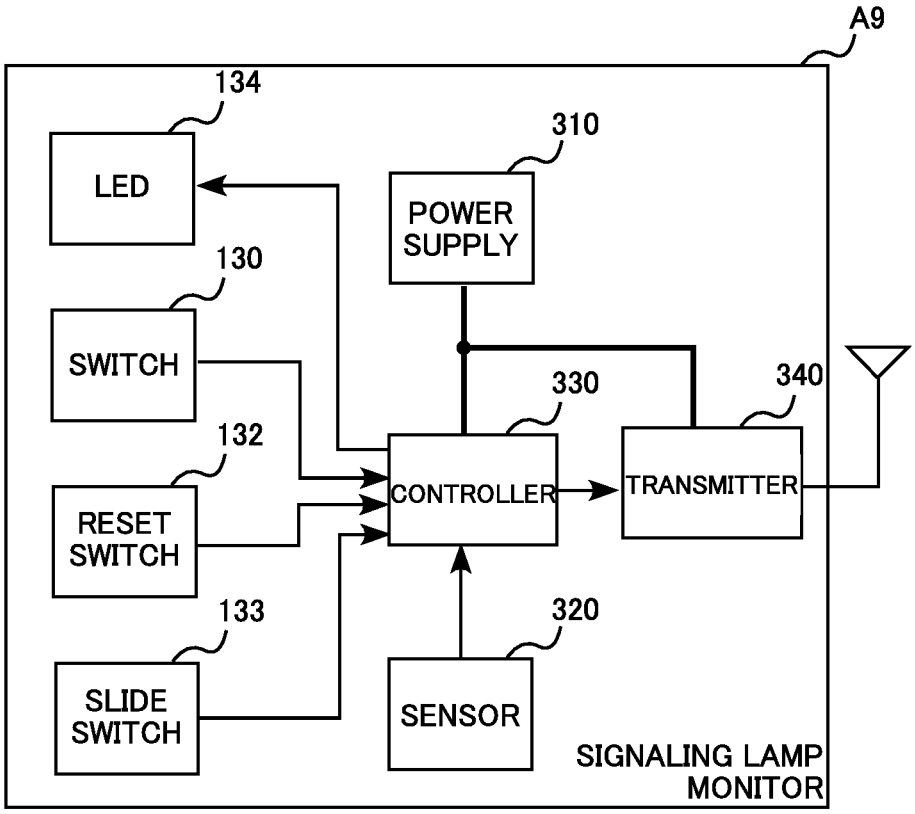
FIG. 29 is a block diagram of the signaling lamp monitor shown in FIG. 24.

FIGS. 24-29 show a signaling lamp monitor according a ninth embodiment. FIG. 24 is a perspective view showing the overall configuration of the signaling lamp monitor according to the ninth embodiment. FIG. 25 is a plan view of the main body of the signaling lamp monitor. FIG. 26 is a plan view of the main body, showing the state seen through the cover 103. In FIG. 26, the cover 103 is shown by dashed lines. FIG. 27 is a front view of the main body of the signaling lamp monitor. In FIG. 27, a part of the internal structure is shown by dashed lines. FIG. 28 is a front view of the detection unit of the signaling lamp monitor. In FIG. 28, the lid 223 is shown as transparent, and the internal structure is shown by dashed lines. FIG. 29 is a block diagram of the signaling lamp monitor. The signaling lamp monitor A9 shown in FIGS. 24-29 differs from the signaling lamp monitor A1 according to the first embodiment (see FIGS. 1-7) in shape of the main body 100, for example. Hereinafter, the difference from the signaling lamp monitor A1 is mainly described.

As shown in FIG. 24, the signaling lamp monitor A9 includes a main body 100, a spacer 105, an attachment 106 and a detection unit 200. According to the stack signaling lamp 900 on which the signaling lamp monitor A9 is to be disposed, a necessary number of spacers 105 are stacked and fixed to the bottom surface of the main body 100 with a screw. The attachment 106 is attached to the spacer 105 that is farthest from the main body 100. By subsequently fixing the attachment 106 to the upper surface of the stack signaling lamp 900, the signaling lamp monitor A9 is attached to the stack signaling lamp 900.

As shown in FIGS. 24-27, in the present embodiment, the housing 101 is generally in the form of a rectangular parallelepiped. The case 102 and the cover 103, which may be made of a white synthetic resin, are each in the form of a bottomed rectangular cylinder.

As shown in FIGS. 26 and 27, the case 102 is provided with a support 102*d*. The support 102*d* stands upright in the y1 direction from the case 102 and supports the wireless module 120.

As shown in FIGS. 24, 25 and 27, the cover 103 has a bottom plate 103*a*. The bottom plate 103*a* forms the bottom of the cover 103 and orthogonal to the y direction. The bottom plate 103*a* is provided with a projection 103*b*. The projection 103*b* stands upright on the bottom plate 103*a* and projects in the y1 direction. The projection 103*b* is rectangular as viewed in plan and arranged at a position offset toward the edge in the x1 direction and toward the edge in the z2 direction of the bottom plate 103*a*. The projection 103*b* has a reflective surface 103*c*, a projection opening 103*d* and a lid 103*e*. The reflective surface 103*c* is the side surface that faces in the x2 direction, among the side surfaces of the projection 103*b* extending perpendicular to the bottom plate 103*a*. The projection opening 103*d* is an opening formed across the surface facing in the y1 direction and the surface facing in the z1 direction of the projection 103*b*. The lid 103*e* is for closing the projection opening 103*d*. The bottom plate 103*a* has an opening 103*f*. The opening 103*f* is a rectangular opening formed in the bottom plate 103*a* and arranged on the x2 side of the projection 103*b*. The opening 103*f* is arranged at a position corresponding to the solar battery 122 of the wireless module 120 housed in the housing 101 so that the light-receiving surface 122*a* of the solar battery 122 is exposed through the opening 103*f*. Thus, the light traveling from the y1 side of the main body 100 becomes incident on the light-receiving surface 122*a* of the solar battery 122. Also, since the bottom plate 103*a* is provided with the projection 103*b* in the present embodiment, the light traveling from the x2 side of the main body 100 is reflected by the reflective surface 103*c* of the projection 103*b* (see dashed arrows in FIG. 27) to become incident on the light-receiving surface 122*a* of the solar battery 122.

As shown in FIGS. 25 and 26, the cover 103 is provided with a partition wall 103*g*. The partition wall 103*g* stands upright in the y2 direction from the bottom plate 103*a* to reach near the front surface 110*a* of the circuit board 110 and extends in the z direction. The partition wall 103*g* divides the front surface 110*a* of the circuit board 110 into a region on the x1 side and a region on the x2 side. The x1-side region overlaps with the projection 103*b* as viewed in plan. Thus, by opening the lid 103*e*, the operator can operate the components in the x1-side region through the projection opening 103*d*. Since the x2-side region is separated by the partition wall 103*g*, the operator cannot operate the components arranged in the x2-side region.

The circuit board 110 fitted in the opening of the case 102 is also rectangular. The front surface 110*a* of the circuit board 110 is divided by the partition wall 103*g* into a region on the x1 side and a region on the x2 side. In the x1-side region are disposed a switch 130, a reset switch 132, variable resistors 140, a slide switch 133, an LED 134 and a battery holder 150. These components can be operated by the operator.

On the other hand, in the x2-side region is disposed a wireless module 120. The wireless module 120 is provided with a connector 124 on the back surface 121*b* of the module board 121. A connector 110*c* is also disposed on the front surface 110*a* of the circuit board 110. By connecting the connector 124 to the connector 110*c*, the wireless module 120 is mounted to the circuit board 110 as spaced apart from the circuit board 110. The wireless module 120 is supported by the support 102*d* provided in the case 102. Between the wireless module 120 and the circuit board 110 are arranged components that need not be operated (or should not be touched) by the operator. Since these components are separated from the projection opening 103*d* by the partition wall 103*g* and arranged between the wireless module 120 and the circuit board 110, operation or contact by the operator is prevented.

In the present embodiment, the antenna 123 of the wireless module 120 is arranged such that its central axis extends in the z1 direction. In the present embodiment, arrangement of metal parts around the antenna 123 is avoided as much as possible so that the electromagnetic waves emitted from the antenna 123 will not be reflected by the surrounding metal. For example, metal parts such as the battery holder 150 are arranged on the z2 side, while the antenna 123 is arranged on the z1 side. Also, the provision of wiring is avoided as much as possible in the region of the front surface 110*a* of the circuit board 110 in which the antenna 123 is provided. Thus, although the antenna 123 does not extend in the y1 direction, it performs communication without problems.

In the present embodiment, the main body 100 is provided with a reset switch 132 in addition to the switch 130. The reset switch 132 is for resetting the wireless module 120 to the initial state. The reset switch 132 is also provided with a push button 131. In the present embodiment, the switch 130 is used to transmit the ID number set in the signaling lamp monitor A9 to the management apparatus 800. As shown in FIG. 29, the operator's pressing the push button 131 causes an operation signal from the switch 130 or the reset switch 132 to be inputted into the controller 330. Upon receiving an operation signal from the switch 130, the controller 330 reads out the ID number from the memory and causes the transmitter 340 to transmit the ID number. Upon receiving an operation signal from the reset switch 132, the controller 330 performs the reset operation. The switch 130 and the reset switch 132 are arranged such that the push buttons 131 extend in the y1 direction. The variable resistors 140 are arranged such that the surfaces formed with the adjustment grooves 141 face in the y1 direction.

In the present embodiment, the battery holder 150 is configured to receive a cylindrical lithium battery (e.g. CR2). The controller 330 detects the voltage to monitor the presence or absence of a battery in the battery holder 150 as well as the voltage and periodically transmits a signal corresponding to the detection result to the management apparatus 800.

In the present embodiment, the main body 100 is further provided with the slide switch 133 and the LED 134.

The slide switch 133 is for switching the operation mode. As shown in FIG. 29, the controller 330 switches the control based on the input through the slide switch 133, to thereby switch the operation mode. As shown in FIG. 26, the slide switch 133 has two selector switches. One of these switches is for switching between a normal mode and an energy saving mode. While this switch is switched to the normal mode, the interval of measurement for identifying the light emission state is 10 seconds, and the interval of regular transmission of a detection signal is 30 seconds (as in the first embodiment). On the other hand, while this switch is switched to the energy saving mode, the interval of measurement for identifying the light emission state is 60 seconds, and the interval of regular transmission of a detection signal is 30 minutes. In the energy saving mode, the measurement interval and the transmission interval are made longer, which contributes to reduction of power consumption. Note that the time set as the measurement interval or the transmission interval is not limited to these examples but may be varied appropriately. The other switch is provided as a spare switch. A predetermined operation mode may be set to the spare switch in the future version upgrade, for example.

The LED 134, which is for informing the communication condition, lights while the signaling lamp monitor A9 is transmitting a detection signal. As shown in FIG. 29, the controller 330 outputs current to the LED 134 while it is causing the transmitter 340 to transmit a detection signal. This causes the LED 134 to light.

In the present embodiment, the connector 160 is arranged at the end in the z1 direction of the front surface 110*a* of the circuit board 110, and the relay cable 290 is connected to the connector. The relay cable 290 extends out of the housing 101 through the gap between the case 102 and the cover 103 to be connected to the detection unit 200.

As shown in FIGS. 24 and 28, in the present embodiment, the detection unit 200 is constituted of a single detection block 260, as with the fourth embodiment. In the present embodiment, to enhance the light-shielding properties, the case 211 is made of a synthetic resin (e.g. ABS resin) to which an additive for reducing light transmission is added, and its inner surfaces are colored black to shield the light. Note that the material for the case 211 may vary. Although an additive is added and also the inner surfaces are colored to enhance the light-shielding properties of the case 211 in the present embodiment, only one of these techniques may be employed. The case 211 further extends in the y1 direction and has a mount base 211*f* at the end in the y1 direction. The mount base 211*f* is for mounting the detection block 260 to the main body 100. The detection block 260 is mounted to the main body 100 by first connecting the connector 213 to the connector 292 located outside the housing 101 and then fixing the mount base 211*f* to the cover 103 of the main body 100 with screws, as shown in FIG. 24.

As shown in FIG. 28, in the case 211, the wall on the x1 side and the wall on the x2 side are extended in the z2 direction, and a lid 223 and a transparent plate 224 are disposed between these two walls, as with the variation of the sensor block 220 described above. The lid 223 is a rectangular plate made of the same material as that for the case 211, and four windows 223*a* are provided at positions corresponding to the photodiodes 225, 235, 245 and 255. In the present embodiment, the detection block 260 has partition plates 227. The partition plates 227 are made of the same material as that for the case 211, and have a longer side equal to the distance between the x1-side wall and the x2-side wall of the case 211 and a shorter side equal to the distance between the sensor board 222 and the lid 223. The partition plates 227 are arranged between the sensor board 222 and the lid 223 so as to be perpendicular to these members. The partition plates 227 are arranged at five locations, namely, between adjacent two of the photodiodes 225, 235, 245 and 255, on the y1 side of the photodiode 225, and on the y2 side of the photodiode 255. With this arrangement, the photodiodes 225, 235, 245 and 255 are shielded from light by the partition plates 227, the case 211, the board 222 and the lid 223, to thereby receive only the light passing through the windows 223*a*. Note that the material for the lid 223 and the partition plate 227 may vary.

In the present embodiment, communication function can be easily added to the stack signaling lamp 900 in a short time and at low cost, as with the first embodiment. The light-receiving surface 122*a* of the solar battery 122 is exposed through the opening 103*f*, and the reflective surface 103*c* is arranged on the x1 side of the opening 103*f*. Thus, the light traveling from the x2 side of the main body 100 is reflected by the reflective surface 103*c* to become incident on the light-receiving surface 122*a* of the solar battery 122. This arrangement allows the solar battery 122 to utilize not only the light traveling from the y1 direction but also the light traveling from the x2 direction, which results in an increase in electric power generation.

Moreover, the projection 103*b* has the projection opening 103*d* and the lid 103*e*. Thus, the operator can open the lid 103*e* and operate the components disposed below the projection 103*b* (i.e., in the y2 direction) through the projection opening 103*d*. By keeping the lid 103*e* closed, dust and dirt are prevented from entering the main body 100. Moreover, since the cover 103 is provided with the partition wall 103*g*, the components arranged in the region shielded by the partition wall 103*g* are protected from operation or contact by the operator through the projection opening 103*d*.

The support 102*d* is formed in the case 102 to support the wireless module 120. Thus, tilting of the wireless module 120 is avoided. This prevents formation of a gap between the light-receiving surface 122*a* of the solar battery 122 and the opening 103*f* and the resulting intrusion of dust or dirt into the main body 100 through such a gap.

The slide switch 133 switches the operation mode between the normal mode and the energy saving mode. While the operation mode is switched to the energy saving mode, the measurement interval and the transmission interval are longer than while the operation mode is switched to the normal mode, so that power consumption is reduced. By switching the slide switch 133, the operator can select the normal mode in which measurement and signal transmission are performed frequently or the energy saving mode in which power consumption is reduced.

The signaling lamp monitor according to the present disclosure is not limited to the foregoing embodiments. The specific configuration of each part of the signaling lamp monitor according to the present disclosure may be varied in many ways.

The invention claimed is:

1. A signaling lamp monitor configured to be attached to a signaling lamp that indicates information by light, the signaling lamp monitor comprising:

a detector configured to detect light from the signaling lamp;

a first board having a first surface on which the detector is mounted;

a controller configured to generate a detection signal based on a detected state by the detector;

a second board having a second surface on which the controller is mounted; and a transmitter configured to transmit the detection signal, wherein the controller is configured to check the detected state at timings of a first interval, when the detected state is changed at a given timing, the controller is configured to generate the detection signal before a next timing subsequent to the given timing comes, and the first surface is perpendicular to the second surface.

2. The signaling lamp monitor according to claim 1, wherein the controller is configured to generate the detection signal at timings of a second interval that is longer than the first interval when the detected state remains unchanged at consecutive timings of the first interval.

3. The signaling lamp monitor according to claim 1, wherein the transmitter is configured to transmit the detection signal by wireless communication.

4. The signaling lamp monitor according to claim 1, wherein the transmitter comprises an antenna disposed above the detector.

5. The signaling lamp monitor according to claim 1, further comprising a solar battery for supplying electric power to the transmitter.

6. The signaling lamp monitor according to claim 1, wherein the first interval is predetermined prior to the detection of the light from the signaling lamp by the detector.

7. The signaling lamp monitor according to claim 1, wherein the detector comprises a plurality of light detection elements arranged along a length of the signaling lamp.

8. The signaling lamp monitor according to claim 7, wherein the plurality of light detection elements are vertically spaced apart from each other.

9. A signaling device, comprising:

a signaling lamp; and the signaling lamp monitor of claim 1 attached to the signaling lamp.

* * * * *